US007986897B2

(12) United States Patent
Nishimura

(10) Patent No.: US 7,986,897 B2
(45) Date of Patent: Jul. 26, 2011

(54) IMAGE FORMING APPARATUS, DEVELOPER CARTRIDGE AND PHOTOSENSITIVE UNIT

(75) Inventor: Yoh Nishimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 527 days.

(21) Appl. No.: 12/142,026

(22) Filed: Jun. 19, 2008

(65) Prior Publication Data

US 2008/0317499 A1 Dec. 25, 2008

(30) Foreign Application Priority Data

Jun. 21, 2007 (JP) ..... 2007-163923

(51) Int. Cl.
*G03G 15/00* (2006.01)

(52) U.S. Cl. ..... 399/90

(58) Field of Classification Search ..... 399/90, 399/113

See application file for complete search history.

(56) References Cited

U.S. PATENT DOCUMENTS

| | | | | |
|---|---|---|---|---|
| 6,493,519 | B2 | 12/2002 | Sasame et al. | |
| 6,714,745 | B2 * | 3/2004 | Sasame et al. | 399/25 |
| 6,751,428 | B2 | 6/2004 | Okabe | |
| 6,944,415 | B2 * | 9/2005 | Nomura | 399/111 |
| 7,174,117 | B2 | 2/2007 | Okabe | |
| 7,272,336 | B1 * | 9/2007 | Dawson et al. | 399/90 |
| 2006/0285880 | A1 | 12/2006 | Okabe | |
| 2007/0071481 | A1 * | 3/2007 | Kamimura | 399/90 |
| 2007/0071482 | A1 * | 3/2007 | Okabe | 399/90 |
| 2008/0199204 | A1 * | 8/2008 | Ishii et al. | 399/90 |
| 2008/0240778 | A1 * | 10/2008 | Ishikawa et al. | 399/119 |

FOREIGN PATENT DOCUMENTS

| | | |
|---|---|---|
| JP | 2001-215862 | 8/2001 |
| JP | 2003-084647 | 3/2003 |
| JP | 2003-280313 | 10/2003 |

* cited by examiner

*Primary Examiner* — David M Gray
*Assistant Examiner* — Rodney Bonnette
(74) *Attorney, Agent, or Firm* — Banner & Witcoff, Ltd

(57) ABSTRACT

An image forming apparatus is described. The image forming apparatus may include a developer cartridge and a photosensitive unit. The developer cartridge may include a first casing accommodating a developing agent, a developing agent carrier supported by the first casing and carrying the developing agent, a memory element storing predetermined information, and a first terminal electrically connected with the memory element. The photosensitive unit may include a second casing to which the developer cartridge is detachably attached, a photosensitive member, with which the developing agent carrier is brought into pressure contact when the developer cartridge is attached to the second casing, supported by the second casing, and a second terminal electrically connected with the first terminal when the developing agent carrier is brought into pressure contact with the photosensitive member.

16 Claims, 13 Drawing Sheets

IMAGE FORMING APPARATUS, DEVELOPER CARTRIDGE AND PHOTOSENSITIVE UNIT

CROSS REFERENCE TO RELATED APPLICATION

This application claims priority to Japanese Patent Application No. 2007-163923 filed on Jun. 21, 2007, the disclosure of which is hereby incorporated into the present application by reference.

TECHNICAL FIELD

The present invention relates to an image forming apparatus such as a laser printer, a photosensitive unit provided in the image forming apparatus, and a developer cartridge provided in the photosensitive unit.

BACKGROUND

An image forming apparatus having a main body to which a process unit is detachably attached is known in general. The process unit includes a developer cartridge accommodating a toner and having a developing roller, and a drum cartridge, to which the developer cartridge is detachably attached, provided with a photosensitive drum.

In such an image forming apparatus, it is known that the developer cartridge attached to the drum cartridge is pressed against the photosensitive drum during image formation, in order to bring the developing roller into contact with the photosensitive drum.

For example, the following image forming apparatus is proposed (refer to Japanese Unexamined Patent Publication No. 2003-84647, for example): A pair of first inclined guide portions are provided on the right and left sides inside a main body case, and a pair of second inclined guide portions arranged therebetween guide the bottom surface of a drum cartridge. When the center axis of the rotation of a photosensitive drum reaches insertion end positions of the first inclined guide portions, the rear portion of the drum cartridge is pivoted downward, so that the drum cartridge is received in a receiving section. Front and rear holders and an urging spring provided in the receiving section sandwich lateral engaging portions protruding from the right and left sides of a developer cartridge, to elastically urge and fix the same.

In another image forming apparatus, it is known that a developer cartridge is provided with a memory which stores information related to the specification and the hysteresis of the developer cartridge, so that a CPU provided in the main body of the image forming apparatus can read the information stored in the memory when the developer cartridge is attached to the main body, to execute image formation corresponding to the developer cartridge.

For example, the following image forming apparatus is proposed (refer to Japanese Unexamined Patent Publication No. 2001-215862, for example): A plurality of cartridges having developer units accommodating developing agents of different colors respectively are attachable to/detachable from this image forming apparatus, in order to develop latent images formed on image carriers. The cartridges are provided with memory units respectively. When an image is monochromatically formed with one of the cartridges, the memory units of the remaining cartridges store information about the monochromatic image formation.

When the developer cartridge is pressed against the photosensitive drum in the aforementioned image forming apparatus, the pressing force of the developing roller to the photosensitive drum must be uniformized, in order to excellently develop a latent image provided on the photosensitive drum.

In order to read the information stored in the memory provided on the developer cartridge with the CPU in the main body, on the other hand, terminals provided on the memory and CPU respectively must be pressed against each other to reliably come into contact with each other, when the developer cartridge is attached to the main body of the image forming apparatus.

If the pressing force for bringing the terminals into contact with each other influences the pressing force of the developing roller to the photosensitive drum, however, the pressing force of the developing roller to the photosensitive drum may be destabilized, so that the latent images may not be excellently developed.

SUMMARY

One aspect of the present invention may provide an image forming apparatus capable of reading information from a memory element with a control section by reliably electrically connecting a first terminal, a second terminal and a third terminal with one another without inhibiting pressure contact between a developing agent carrier and a photosensitive member with a simple structure, a photosensitive unit provided in the image forming apparatus, and a developer cartridge provided in the photosensitive unit.

Another aspect of the present invention may provide an image forming apparatus including a developer cartridge including: a first casing accommodating a developing agent; a developing agent carrier supported by the first casing and carrying the developing agent; a memory element storing predetermined information; and a first terminal electrically connected with the memory element, a photosensitive unit including: a second casing to which the developer cartridge is detachably attached; a photosensitive member, with which the developing agent carrier is brought into pressure contact when the developer cartridge is attached to the second casing, supported by the second casing; and a second terminal electrically connected with the first terminal when the developing agent carrier is brought into pressure contact with the photosensitive member, and a main body unit including: a third casing receiving the photosensitive unit; a control section provided in the third casing; and a third terminal electrically connected with the control section, and electrically connected with the second terminal when the third casing receives the photosensitive unit.

One or more aspects of the present invention provide a developer cartridge including: a first casing accommodating a developing agent; a developing agent carrier supported by the first casing and carrying the developing agent; a grip having one end pivotably supported by the first casing and the other end swung to approach to or separate from the first casing; a memory element storing predetermined information; and a first terminal electrically connected with the memory element and provided on the grip.

One or more aspects of the present invention provide a developer cartridge including: a first casing accommodating a developing agent; a developing agent carrier supported by the first casing and carrying the developing agent; a grip having one end pivotably supported by the first casing and the other end swung to approach to or separate from the first casing; a memory element storing predetermined information; a first terminal electrically connected with the memory element and provided on the grip; wiring connecting the memory element and the first terminal with each other; and an elastic member provided in an intermediate position of the wiring, pressed by the grip to allow conduction of the wiring when the other end of the grip is swung in a direction for approaching to the first casing, and released from the pressing by the grip to interrupt the conduction of the wiring when the other end of the grip is swung in a direction for separating from the first casing.

One or more aspects of the present invention provide a photosensitive unit including: a second casing, to which a developer cartridge including a first casing accommodating a developing agent, a developing agent carrier supported by the first casing and carrying the developing agent, a grip having one end pivotably supported by the first casing and the other end swung to approach to or separate from the first casing, a memory element storing predetermined information, and a first terminal electrically connected with the memory element and provided on the grip is detachably attached; a photosensitive member, with which the developing agent carrier is brought into pressure contact when the developer cartridge is attached to the second casing, supported by the second casing; and a second terminal electrically connected with the first terminal when the developing agent carrier is brought into pressure contact with the photosensitive member.

DETAILED DESCRIPTION

Embodiments of the present invention are now described with reference to the drawings.

First Embodiment

1. Overall Structure of Color Laser Printer

Figure 1:
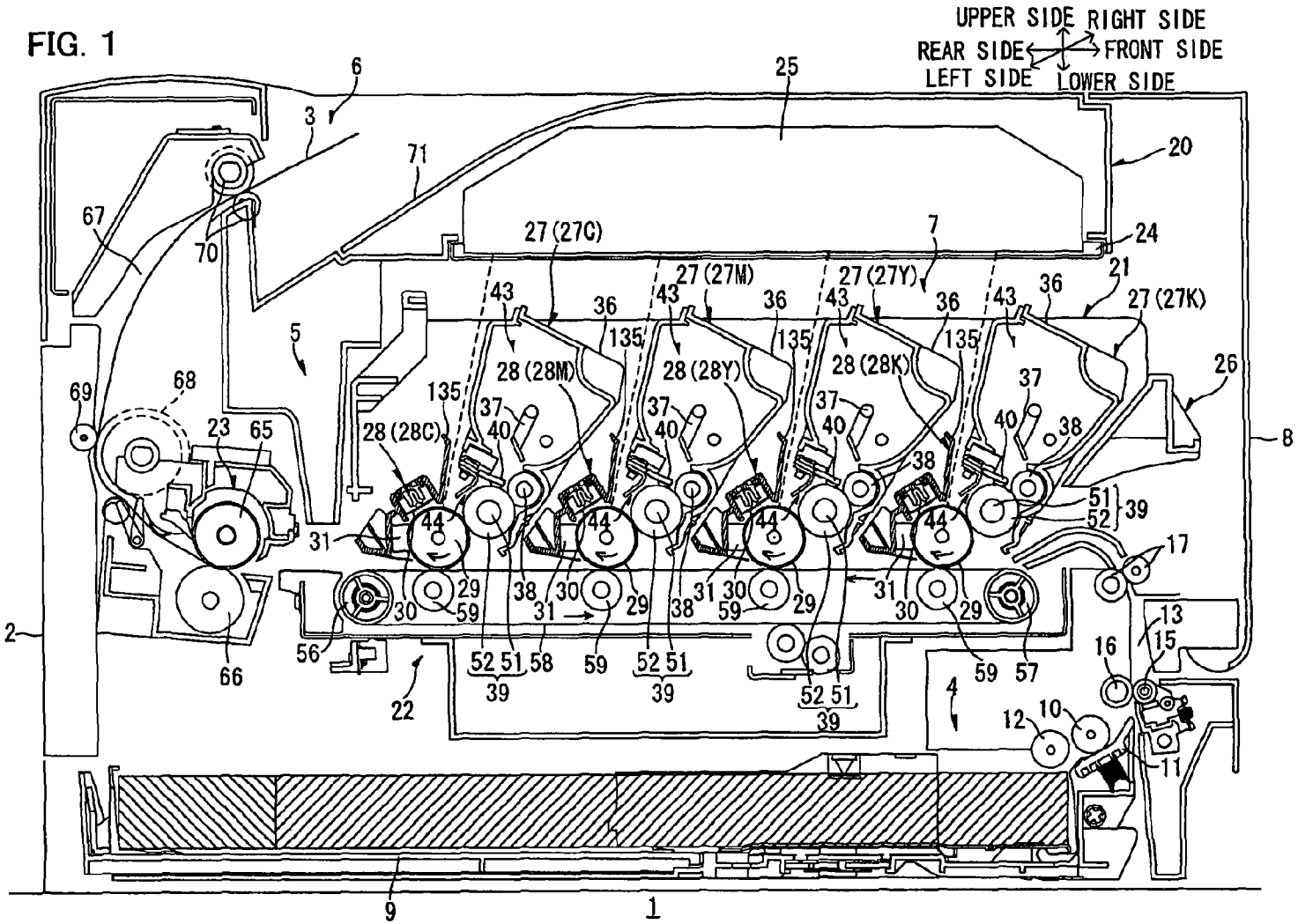
FIG. 1 is a side sectional view showing an illustrative aspect of a color laser printer as an example of an image forming apparatus.

FIG. 1 is a side sectional view showing an illustrative aspect of a color laser printer as an example of an image forming apparatus. FIG. 1 omits illustration of a grip 103 described later.

This color laser printer 1 is a horizontal tandem type color laser printer in which a plurality of photosensitive drums 29 described later are parallelly arranged in the horizontal direction. The color laser printer 1 includes a sheet feeding section 4 for feeding sheets 3, an image forming section 5 for forming images on the fed sheets 3, and a sheet ejecting section 6 for ejecting the sheets 3 on which the images are formed, in a main body casing 2 as an example of a main body unit and as an example of a third casing.

(1) Main Body Casing

The main body casing 2 is in the form of a generally rectangular box in side elevational view, and a drum receiving space 7 receiving a drum unit 26 described later is formed therein.

A front cover 8 is provided on one side surface (front surface) of the main body casing 2. This front cover 8 is inclined frontward from the main body casing 2 to open the drum receiving space 7, and uprighted along the front surface of the main body casing 2 to close the drum receiving space 7. When the drum receiving space 7 is opened, the drum unit 26 can be attached to/detached from the drum receiving space 7.

In the following description, it is defined that the one side (right side in FIG. 1) where the front cover 8 is provided is the front side, and the side (left side in FIG. 1) opposite thereto is the rear side. The right and left sides are defined with reference to the color laser printer 1 as viewed from the front side. Also as to the drum unit 26 and developer cartridges 27, the front, rear, right, left, upper and lower sides are defined with reference to states where they are attached to the body casing 2, unless otherwise stated.

(2) Sheet Feeding Section

The sheet feeding section 4 includes a sheet feeding tray 9 detachably attached to the bottom of the main body casing 2. A sheet feeding roller 12 is arranged above the front end portion of the sheet feeding tray 9. The sheet feeding section 4 further includes a generally U-shaped sheet feeding transport path 13 formed between the upper front end portion of the sheet feeding tray 9 and a transport belt 58 described later. A separation roller 10, a separation pad 11, a sheet dust removing roller 15, a pinch roller 16 and a pair of registration rollers 17 are provided on the sheet feeding transport path 13.

The sheet feeding roller 12 rotates so as to deliver the sheets 3 stacked on the sheet feeding tray 9 to the sheet feeding transport path 13. Thereafter the sheets 3 are separated one by one from one another between the separation roller 10 and the separation pad 11. Then, the sheets 3 pass through the space between the sheet dust removing roller 15 and the pinch roller 16, the sheet dust removing roller 15 removes sheet dust therefrom, and the sheets 3 are thereafter transported to the registration roller 17. The registration roller 17 delivers the sheets 3 toward the transport belt 58 described later after registration.

(3) Image Forming Section

The image forming section 5 includes a scanning section 20, a processing section 21, a transferring section 22 and a fixing section 23.

(3-1) Scanning Section

The scanning section 20 is arranged on an upper portion of the main body casing 2. This scanning section 20 includes a scanner unit 25 and a scanner casing 24 fixed to the upper portion of the main body casing 2 to receive the scanner unit 25.

The scanner unit 25 is provided therein with optical members such as four light sources, a polygonal mirror, an fθ lens, a reflecting mirror and a face tangle error correction lens. Laser emitted from the light sources on the basis of image data are deflected and scanned by the polygonal mirror, pass through the fθ lens and the face tangle error correction lens, are reflected by the reflecting mirror, and thereafter applied to the surfaces of the photosensitive drums 29 of respective colors described later in high-speed scanning.

(3-2) Processing Section

The processing section 21 is arranged under the scanning section 20 and above the sheet feeding section 4, and includes one drum unit 26 as an example of photosensitive unit and four developer cartridges 27 corresponding to the respective colors.

(3-2-1) Drum Unit

The drum unit 26 includes four drum subunits 28 correspondingly to the respective colors, as an example of a second casing. In other words, the drum subunits 28 include a black drum subunit 28K, a yellow drum subunit 28Y, a magenta drum subunit 28M and a cyan drum subunit 28C, which are arranged from the front side toward the rear side at intervals from one another.

Each drum subunit 28 includes a pair of side frames 134 and a center frame 135 extended therebetween, as described later (see FIG. 8).

Each drum subunit 28 supports the corresponding photosensitive drum 29 as an example of a photosensitive member, a scorotron charger 30 and a cleaning brush 31.

The photosensitive drum 29 is supported by the pair of side frames 134 along the right-and-left direction, and is provided rotatably about the central axis thereof.

The scorotron charger 30 is supported by the center frame 135, and arranged obliquely above the rear side of the photosensitive drum 29, to be opposed to the photosensitive drum 29 at an interval.

The cleaning brush 31 is supported by the center frame 135 at the back of the photosensitive drum 29, and so arranged as to oppositely come into contact with the photosensitive drum 29.

(3-2-2) Developer Cartridge

The developer cartridge 27 is attachably/detachably provided correspondingly to the drum subunit 28 corresponding to each color.

In other words, a black developer cartridge 27K is provided correspondingly to the black drum subunit 28K. A yellow developer cartridge 27Y is provided correspondingly to the yellow drum subunit 28Y. A magenta developer cartridge 27M is provided correspondingly to the magenta drum subunit 28M. A cyan developer cartridge 27C is provided correspondingly to the cyan drum subunit 28C.

Each developer cartridge 27 includes a developer frame 36 as an example of a first casing, and includes an agitator 37, a supply roller 38, a developing roller 39 as an example of a developing agent carrier and a layer-thickness regulating blade 40 provided on the developer frame 36.

The developer frame 36 is in the form of a box having an opening 41 (see FIG. 4) provided in the lower end portion thereof. This developer frame 36 is partitioned into a toner accommodation chamber 43 on the upper side and a developing chamber 44 on the lower side. The toner accommodation chamber 43 and the developing chamber 44 communicate with each other.

The toner accommodation chamber 43 accommodates a toner, more specifically a positively charged non-magnetic single component polymer toner, as an example of a developing agent corresponding to each of black, yellow, magenta and cyan.

The agitator 37 is arranged in the toner accommodation chamber 43.

The supply roller 38 is arranged on a front upper portion in the developing chamber 44.

The developing roller 39 is arranged obliquely under the rear side of the supply roller 38 in the developing chamber 44. The developing roller 39 includes a developing roller shaft 51 made of metal rotatably supported by the developing frame 36 along the right-and-left direction, and a rubber roller 52 made of conductive rubber covering the periphery of the developing roller shaft 51. The lower side of the rubber roller 52 is exposed from the opening 41, and the upper side thereof is elastically in pressure contact with the supply roller 38.

The layer-thickness regulating blade 40 is arranged in the developing chamber 44. This layer-thickness regulating blade 40 includes a rubber member on the lower end of a leaf spring member made of metal. The upper end of the leaf spring member is fixed to the developer frame 36, and the rubber member presses the rubber roller 52 from above.

(3-2-3) Developing Operation in Processing Section

In each developer cartridge 27, the toner accommodated in the toner accommodation chamber 43 is agitated by the agitator 37, and discharged into the developing chamber 44 by the own weight thereof.

Thereafter the toner is fed to the supply roller 38, and further fed to the developing roller 39 due to rotation of the supply roller 38. At this time, the toner is frictionally charged to positive polarity between the supply roller 38 and the developing roller 39 to which developing bias is applied.

Thereafter the layer-thickness regulating blade 40 scrapes excessive part of the toner off the developing roller 39 following rotation thereof, so that the toner is carried on the surface of the developing roller 39 as a thin layer having a constant thickness.

In the drum subunit 28 corresponding to each developer cartridge 27, on the other hand, the surface of the photosensitive drum 29 is uniformly positively charged by corona discharge of the scorotron charger 30.

The laser from the scanning section 20 is applied to the positively charged surface of the photosensitive drum 29, thereby forming an electrostatic latent image corresponding to an image to be formed on each sheet 3.

When the electrostatic latent image formed on the surface of the photosensitive drum 29 is opposed to the developing roller 39 following rotation of the photosensitive drum 29, the toner carried on the surface of the developing roller 39 is fed to the electrostatic latent image (in other words, a portion which is exposed by the laser and whose potential is reduced in the uniformly positively charged surface of the photosensitive drum 29). Thus, the electrostatic latent image is visualized, and a toner image is carried on the surface of the photosensitive drum 29.

(3-3) Transferring Section

The transferring section 22 is arranged above the sheet feeding section 4 and under the processing section 21 in the main body casing 2. The transferring section 22 includes a driving roller 56, a driven roller 57, the transport belt 58 and transfer rollers 59.

The driving roller 56 and the driven roller 57 are anteroposteriorly opposed to each other at an interval. The transport belt 58 is formed by an endless belt, and wound between the driving roller 56 and the driven roller 57.

Upon rotation of the driving roller 56, the transport belt 58 circularly moves between the driving roller 56 and the driven roller 57 to rotate in the same direction as the photosensitive drum 29 in a transfer position where the transfer belt 58 opposedly comes into contact with each photosensitive drum 29.

Inside the wound transport belt 58, the transfer roller 59 is opposed to each photosensitive drum 29 with the transport belt 58 sandwiched therebetween. Each transfer roller 59 rotates in the same direction as that of the circular movement of the transport belt 58 in a driven manner in a transfer position where the transfer roller 59 opposedly comes into contact with the transport belt 58.

The sheet 3 fed from the sheet feeding section 4 is transported by the transport belt 58 from the front side toward the rear side, to successively pass through the transfer position corresponding to each photosensitive drum 29. When the sheet 3 passes through each transfer position, the toner image is transferred from the photosensitive drum 29 to the sheet 3 due to transfer bias applied to the transfer roller 59. Thus, color images are formed on the sheet 3.

Sheet dust from the sheets 3 adhering to the photosensitive drum 29 is collected by the cleaning brush 31 after the transfer.

(3-4) Fixing Section

The fixing section 23 is arranged at the back of the transfer section 22, and includes a heating roller 65 and a pressure roller 66 pressurizing the heating roller 65.

In the fixing section 23, the color image transferred to the sheet 3 is heated and pressurized while the sheet 3 passes through the portion between the heating roller 65 and the pressure roller 66, to be thermally fixed to the sheet 3.

(4) Sheet Ejecting Section

The sheet ejecting section 6 includes a generally C-shaped sheet ejecting transport path 67 opened frontward. A transport roller 68, a pinch roller 69 and a pair of sheet ejecting rollers 70 are provided on the sheet ejecting transport path 67.

The sheet 3 transported from the fixing section 23 is transported by the transport roller 68 and the pinch roller 69 along the sheet ejecting transport path 67, and ejected onto a sheet ejection tray 71 formed on the upper surface of the main body casing 2 by the sheet ejecting rollers 70.

2. Developer Cartridge

Figure 2:
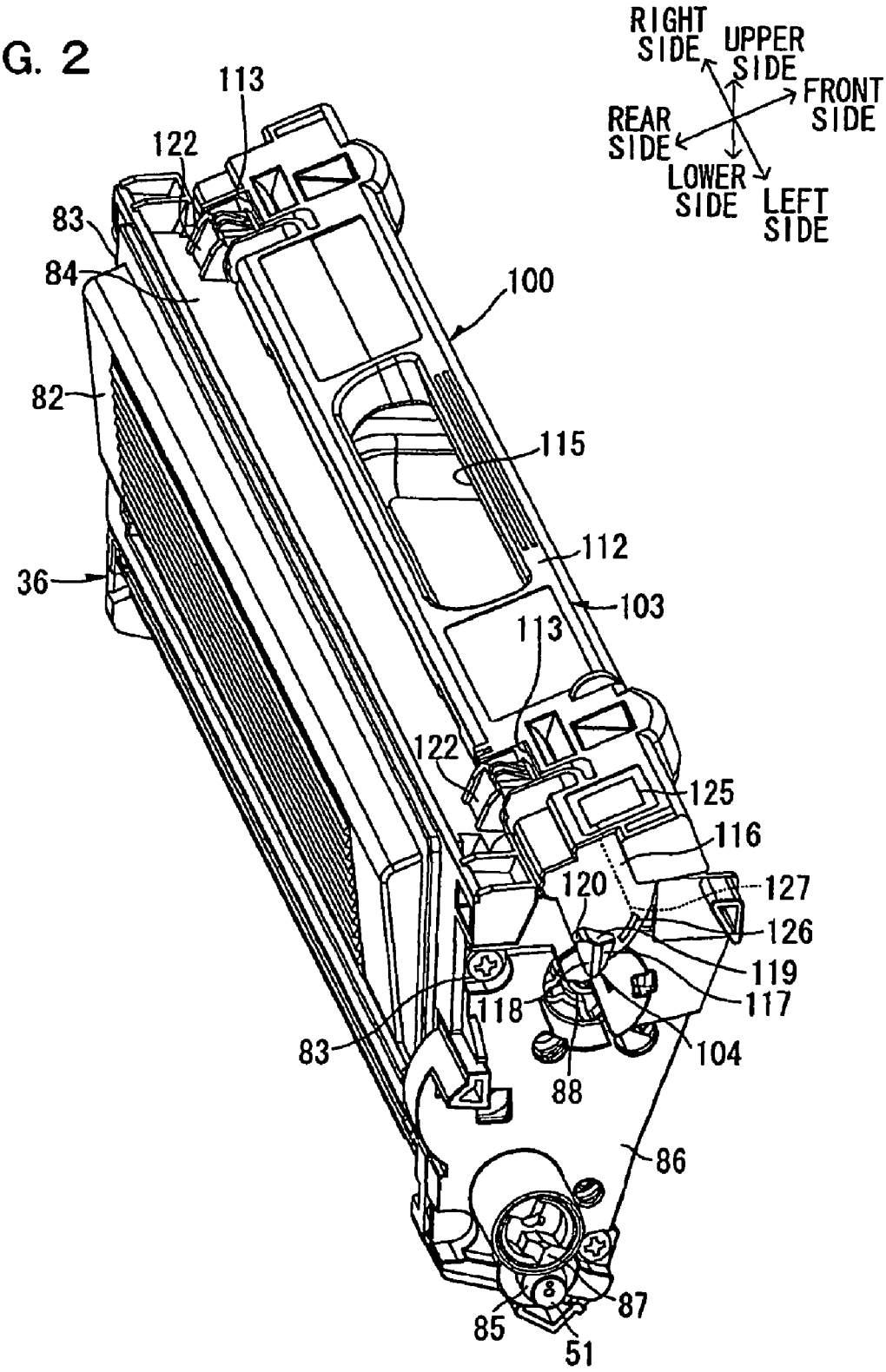
FIG. 2 is a perspective view of a developer cartridge.
Figure 3:
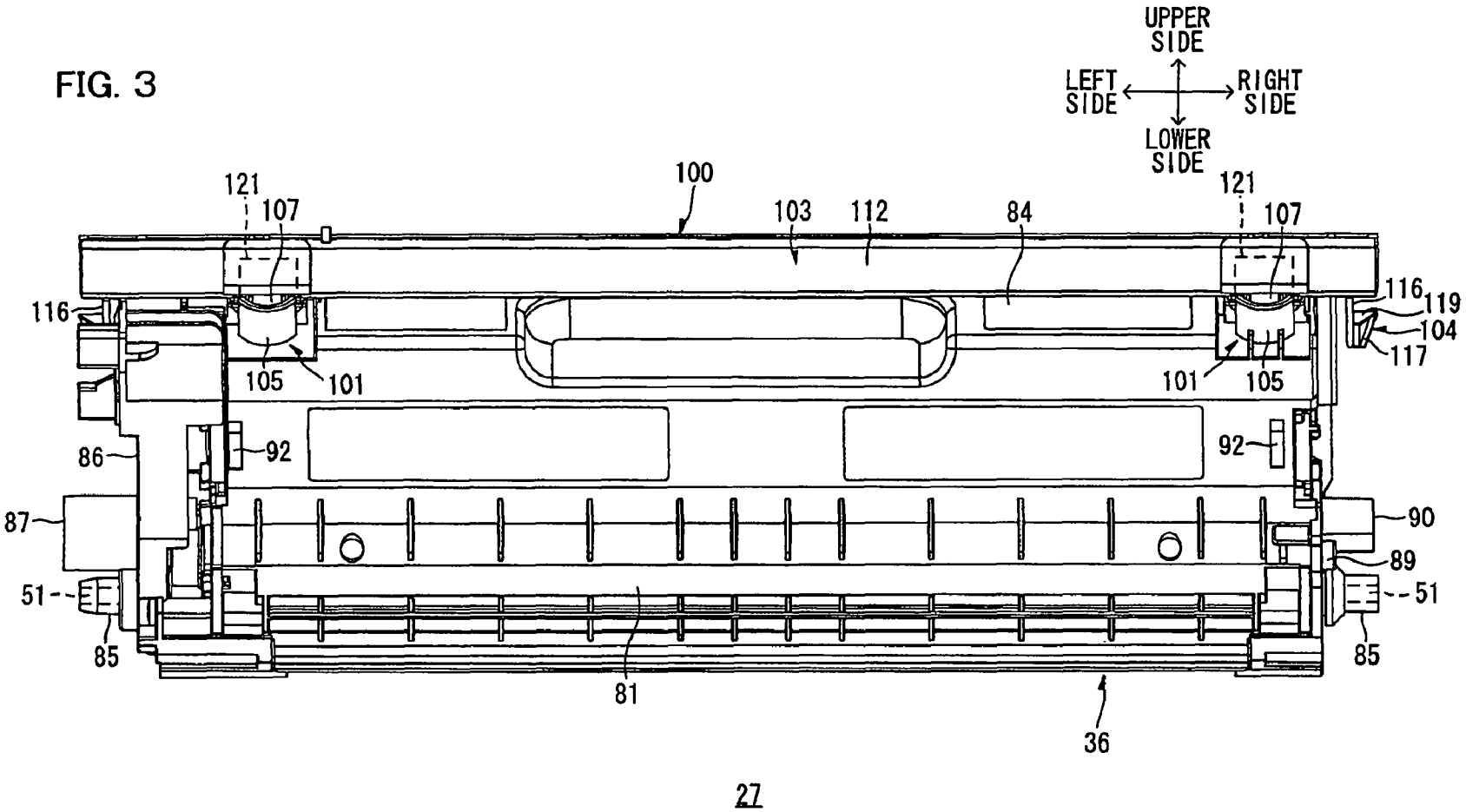
FIG. 3 is a front elevational view of the developer cartridge.
Figure 4:
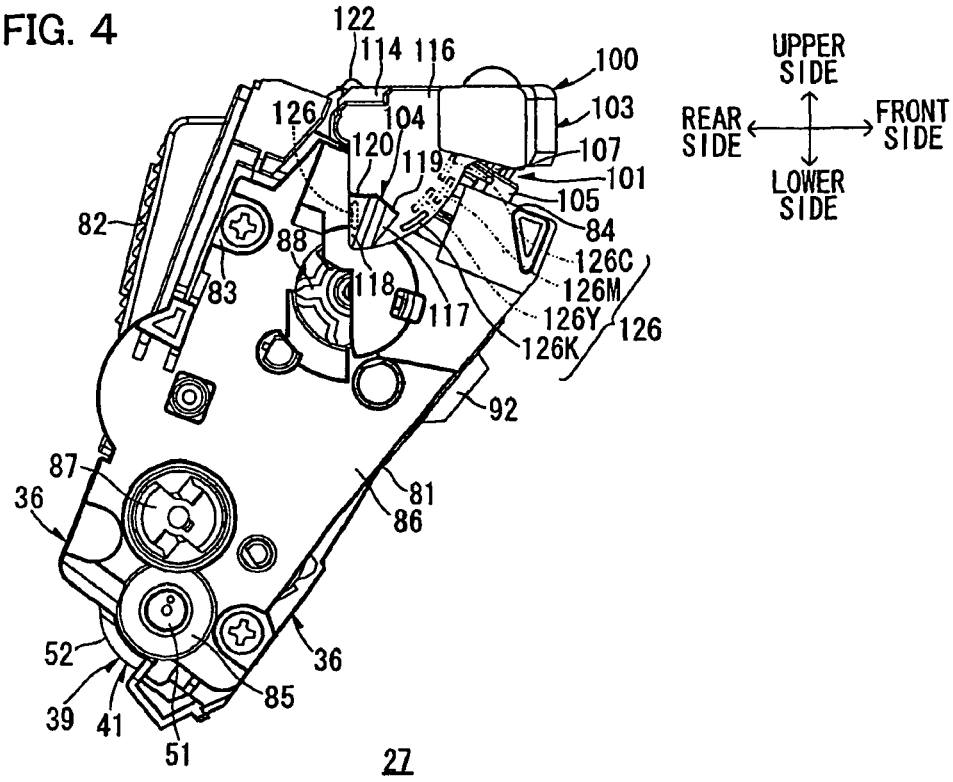
FIG. 4 is a left side elevational view of the developer cartridge.
Figure 5:
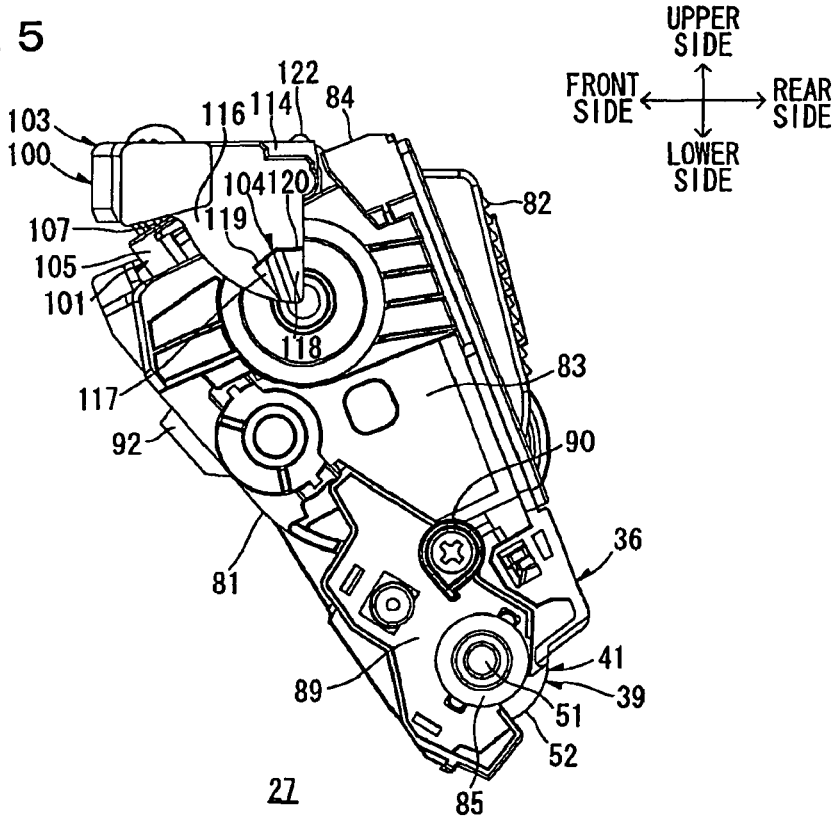
FIG. 5 is a right side elevational view of the developer cartridge.
Figure 6:
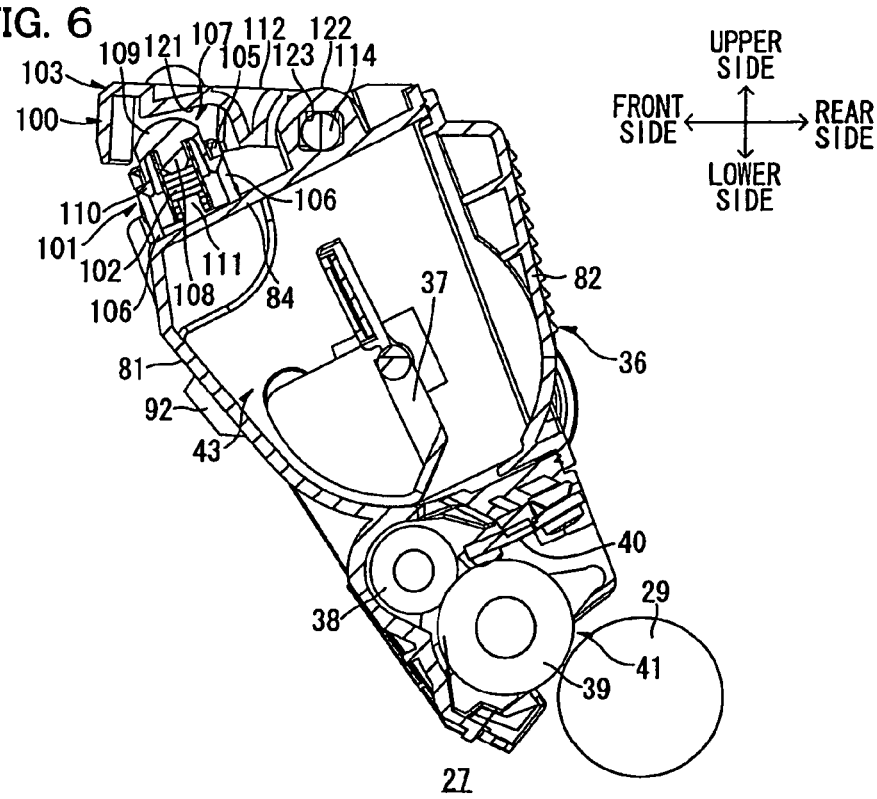
FIG. 6 is a sectional view of the developer cartridge (unpressed state).
Figure 7:
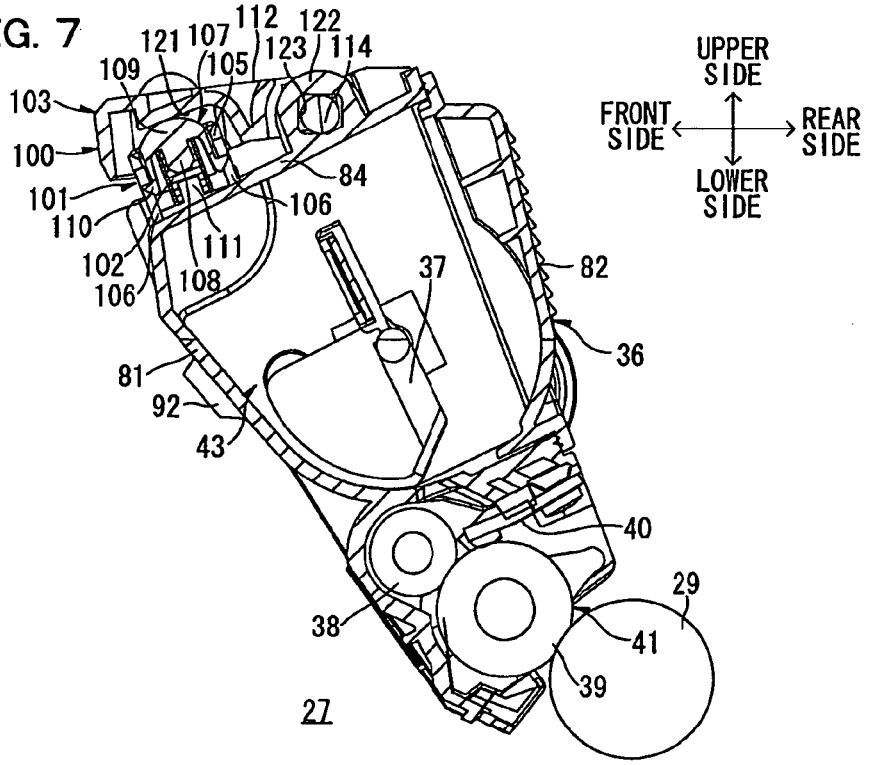
FIG. 7 is a sectional view of the developer cartridge (pressed state).

FIG. 2 is a perspective view of the developer cartridge, FIG. 3 is a front elevational view of the developer cartridge, FIG. 4 is a left side elevational view of the developer cartridge, FIG. 5 is a right side elevational view of the developer cartridge, FIG. 6 is a sectional view of the developer cartridge (unpressed state), and FIG. 7 is a sectional view of the developer cartridge (pressed state). The developer cartridge is now described in detail with reference to FIGS. 3 to 7.

(1) Developer Frame

As described above, the developer frame 36 is in the form of the box having the opening 41 provided on the lower end portion thereof, as shown in FIGS. 2 and 4. The developer frame 36 integrally includes a pair of side walls 83 opposed to each other at an interval in the width direction (i.e. right-and-left direction), an upper wall 84 extended between the upper end edges of the side walls 83, a front wall 81 extended between the front end edges of the side walls 83, and a rear wall 82 extended between the rear end edges of the side walls 83, as shown in FIGS. 2 and 3. The opening 41 is defined by the lower end edges of the side walls 83, the front wall 81 and the rear wall 82.

The side walls 83 of the developer frame 36 rotatably support the developing roller shaft 51. Both axial end portions of the developing roller shaft 51 protrude from the side walls 83 in the width direction respectively. Both axial end portions of the developing roller shaft 51 are covered with conductive collar members 85 respectively.

The left side wall 83 of the developer frame 36 is provided with a gear mechanism section (not shown) and a gear cover 86 covering the gear mechanism section, as shown in FIG. 4.

The gear mechanism section (not shown) includes a coupling passive gear 87 to which driving force is input, a detection gear 88 for determining whether the developer cartridge 27 is old or new, and a gear train (not shown) for transmitting the driving force to the agitator 37, the supply roller 38, the developing roller 39 and the detection gear 88.

The gear cover 86 is provided on the left side wall 83 so as to expose the coupling passive gear 87 and the detection gear 88 and to cover the gear train.

A conductive current supply member 89 is provided on the right side wall 83 of the developer frame 36, as shown in FIG. 5. The current supply member 89 integrally includes a contacting plate 90 bearing the developing roller shaft 51 and protruding outward in the width direction. The developing bias is applied to the contacting plate 90, and further applied to the developing roller shaft 51 through the current supply member 89.

Positioning convexes 92 are provided on the right and left end portions of the front wall 81 of the developer frame 36 respectively, as shown in FIG. 3. These positioning convexes 92 are each generally in the form of trapezoid in side elevational view (see FIGS. 4 and 5), and are so formed as to protrude frontward from the front wall 81.

(2) Attachment/Detachment Operating Portion

The developer frame 36 is provided with an attachment/detachment operating portion 100 for attaching/detaching the developer cartridge 27, as shown in FIG. 2.

This attachment/detachment operating portion 100 is provided on the upper wall 84 of the developer frame 36. The attachment/detachment operating portion 100 includes pressed portions 101 (see FIG. 3) fixed to the upper wall 84, and the grip 103 as an example of a pressing member swingably provided on the upper wall 84.

(2-1) Pressed Portion

The pressed portions 101 are provided on both end portions in the width direction (parallel to the axial direction of the developing roller 39) respectively on the front end portion of the upper wall 84, as shown in FIGS. 3 and 6. Each pressed portion 101 includes a spring receiving cylindrical portion 105, a spring 102 and an abutting member 107.

The spring receiving cylindrical portion 105 is in the form of a cylinder, and so formed as to protrude upward from the upper wall 84. A plurality of engaging grooves 106 extending from the lower end portion of the spring receiving cylindrical portion 105 to an intermediate portion in the up and down direction thereof are formed in the spring receiving cylindrical portion 105 at intervals in the circumferential direction.

A mounting boss 111 having a diameter smaller than the inner diameter of the spring receiving cylindrical portion 105 is provided in the spring receiving cylindrical portion 105. The mounting boss 111 is in the form of a cylinder, and so formed as to protrude upward from the upper wall 84.

The spring 102 is formed by a coil spring (compression spring), inserted into the space between the inner peripheral surface of the spring receiving cylindrical portion 105 and the mounting boss 111, and arranged on a lower portion in the spring receiving cylindrical portion 105.

The abutting member 107 integrally includes a boss portion 108 and a head portion 109 radially swelling out from the upper end portion of the boss portion 108. A plurality of downwardly extending hook portions 110 are formed on the peripheral end portion of the head portion 109 correspondingly to the engaging grooves 106.

In the abutting member 107, the boss portion 108 is arranged on the spring 102 in an upper portion of the spring receiving cylindrical portion 105, the head portion 109 is arranged on the spring receiving cylindrical portion 105, and the hook portions 110 are engaged with the engaging grooves 106 of the spring receiving cylindrical portion 105 slidably in the up and down direction.

The abutting member 107 is upwardly urged by the spring 102 in a normal state, while the hook portions 110 are engaged with the upper end portions of the engaging grooves 106, thereby preventing separation of the abutting member 107 from the spring receiving cylindrical portion 105.

(2-1) Grip

As shown in FIG. 2, the grip 103 integrally includes a grasp plate 112 as an example of a grasp portion in the form of a thin plate extending in the width direction, and side plates 116 as an example of side portions provided on both end portions of the grasp plate 112 in the width direction to extend in a direction orthogonal to the longitudinal direction of the grasp plate 112.

A grasp hole 115 generally in the form of an elongated rectangle in plan view extending in the width direction is formed at the center of the grasp plate 112 in the width direction. The user inserts his/her hand into the grasp hole 115 to grasp the grip 103, in order to attach/detach the developer cartridge 27.

On the lower surface (opposed to the upper wall 84) of the grasp plate 112, a recess 121 is formed on a position opposed to each pressing portion 101 and inside the width direction of the upper wall 84, as shown in FIG. 6. The recess 121 is generally in the form of a circle in bottom plan view capable of receiving the abutting member 107.

Notched portions 113 each notched frontward from the rear end edge generally in the form of rectangle in plan view are formed in the vicinity of both end portions of the grasp plate 112 in the width direction, as shown in FIG. 2. Elastically deformable pivoting shafts 114 protruding in a direction toward which they approach to each other (inward in the width direction) are provided on both inner side walls of the notched portions 113 respectively (see FIG. 6).

On the rear end portion of the upper wall 84, on the other hand, two grip support portions 122 are provided on both end portions in the width direction, correspondingly to the notched portions 113. The grip support portions 122 are each generally U-shaped in side elevational view (see FIG. 6) with a penetration hole 123 formed along the width direction, and are so formed as to extend in the width direction.

The pivoting shafts 114 are brought into contact with the grip support portions 122, elastically deformed and fitted into the penetration holes 123, whereby the grip 103 is supported with respect to the upper wall 84 of the developer frame 36 rotatably about a width-directional pivot axis.

Thus, the rear end of the grip 103 is pivotably supported by the upper wall 84, and the front end thereof is swung to approach to or separate from the upper wall 84. When swung downward toward the front side (pressure contact direction described later), the grip 103 approaches to the upper wall 84, and is arranged on a pressure contact position where each recess 121 thereof comes into pressure contact with each abutting member 107. When swung upward toward the rear side (pressing release direction described later), on the other hand, the grip 103 is arranged on a release position where each recess 121 thereof separates from each abutting member 107 and is released from the pressure contact with each abutting member 107.

The side plates 116 are bent from both end edges of the grasp plate 112 downward in a direction orthogonal to the width direction (more specifically, to be swung toward the upper wall 84). Each side plate 116 is in the form of a sector in side elevational view, and a fitting projection 104 is provided on the lower end portion thereof.

As shown in FIGS. 4 and 5, the fitting projection 104 is generally in the form of a downwardly narrowed triangle in side elevational view, and so provided as to protrude outward from the lower end portion of the side plate 116 in the width direction.

The fitting projection 104 is provided on the front and rear end portions thereof with a front-side inclined surface 117 and a rear-side inclined surface 118 inclined inwardly in the width direction toward the front side and the rear side respectively, as shown in FIG. 3. The upper end portion of the fitting projection 104 is further provided with a front end face 119 and a rear end face 120 inclined downward anteroposteriorly outwardly from the anteroposterior center respectively in side elevational view.

(3) IC Memory and First Terminal

The developer frame 36 is provided with an IC memory 125 as an example of a memory element and a first terminal 126, as shown in FIGS. 2 and 4.

The IC memory 125 is generally in the form of a thin rectangular plate, and embedded in the left end portion of the upper surface of the grasp plate 112, as shown in FIG. 2. The IC memory 125 stores predetermined information about the developer cartridge 27 such as the frequency (number of printed sheets) of an image forming operation and an ID code specific to the developer cartridge 27.

The first terminal 126 is formed by a flat electrode, and provided on the left side plate 116 in the form of a long and narrow arc extending along the swinging direction of the grip 103, as shown in FIG. 4.

On the left side plate 116, the first terminal 126 is arranged on a position varying with each color. More specifically, the black developer cartridge 29K is provided with a black first terminal 126K on a front lower portion of the side plate 116. The yellow developer cartridge 29Y is provided with a yellow first terminal 126Y on a portion in front of and obliquely above the portion where the black first terminal 126K is arranged. The magenta developer cartridge 29M is provided with a magenta first terminal 126M on a front upper portion of the side plate 116 in front of and obliquely above the portion where the yellow first terminal 126Y is arranged. The cyan developer cartridge 29C is provided with a cyan first terminal 126C on a portion, higher than the portion where the yellow first terminal 126Y is arranged, the portion is located in front of and obliquely above the portion where the magenta first terminal 126M is arranged.

FIG. 4 shows the arrangement of the black first terminal 126K with solid lines, while showing the arrangements of the yellow, magenta and cyan first terminals 126Y, 126M and 126C with phantom lines.

The IC memory 125 and the first terminal 126 are electrically connected with each other by wiring 127. The wiring 127 is connected from the IC memory 125 to the first terminal 126 through the grasp plate 112 and the left side plate 116, as shown by a dotted line in FIG. 2.

3. Drum Unit

Figure 8:
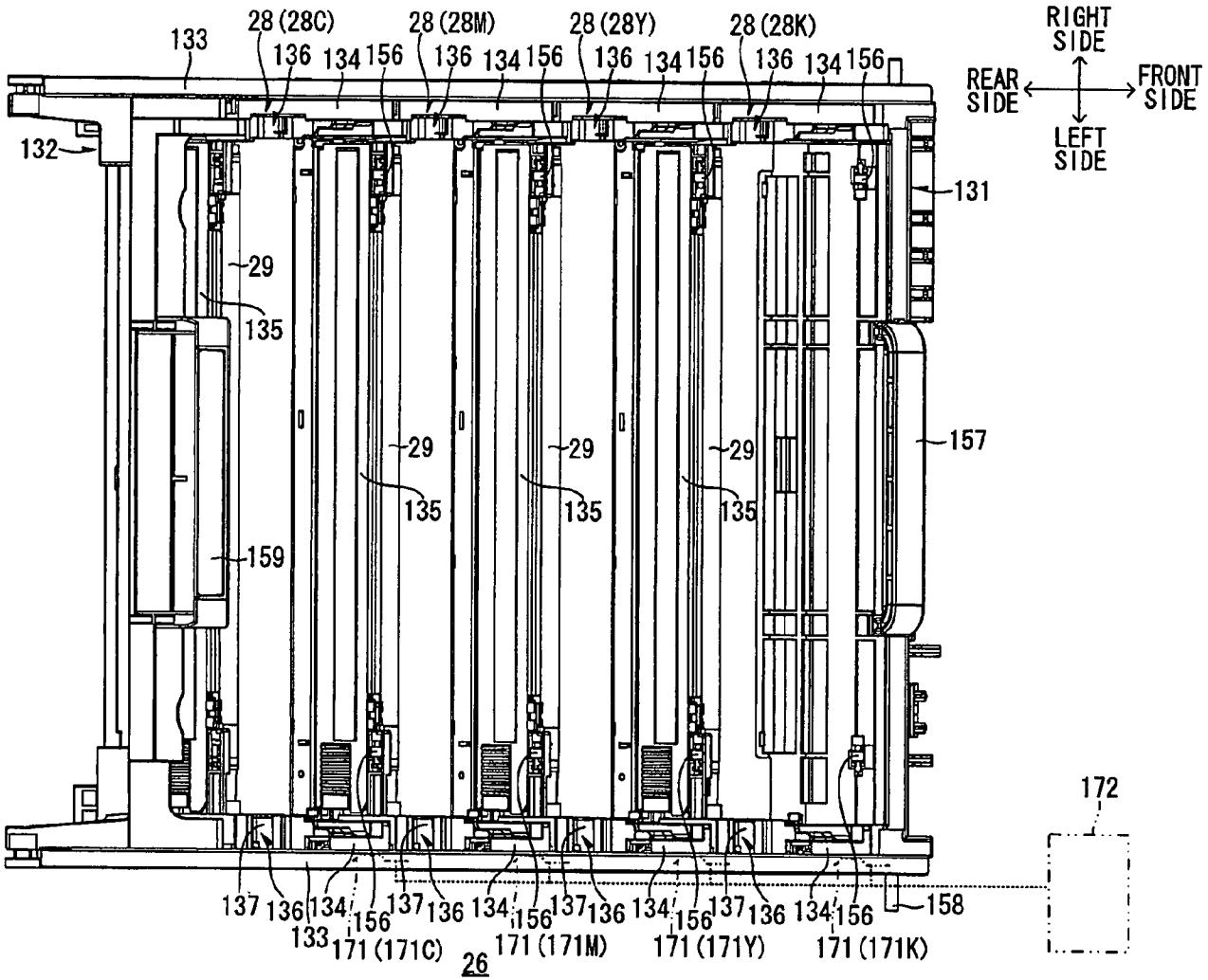
FIG. 8 is a plan view of a drum unit.
Figure 9:
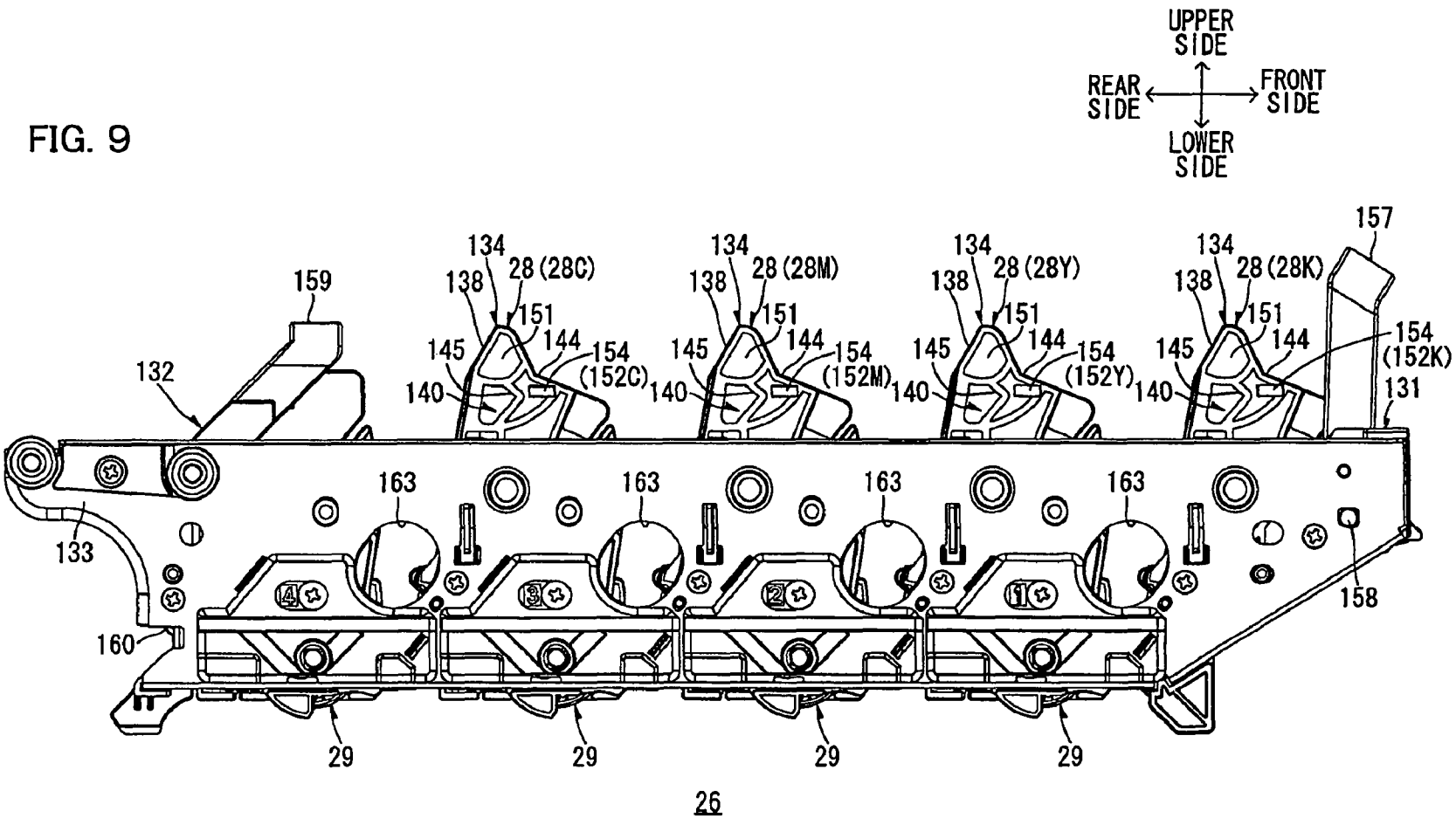
FIG. 9 is a left side elevational view of the drum unit.
Figure 10:
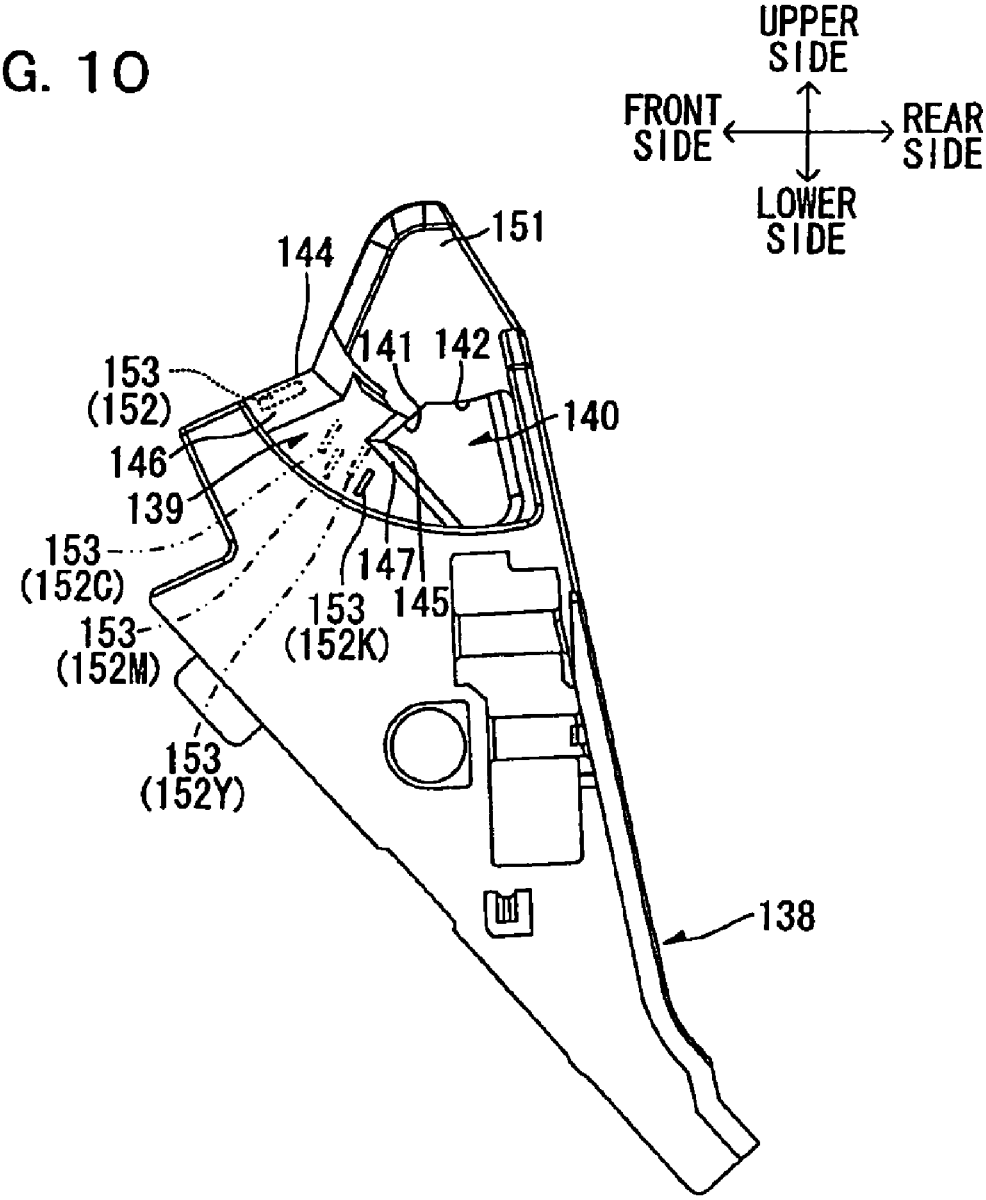
FIG. 10 is a right side elevational view of a portion of a left side frame frontward of a cartridge guide groove.
Figure 11:
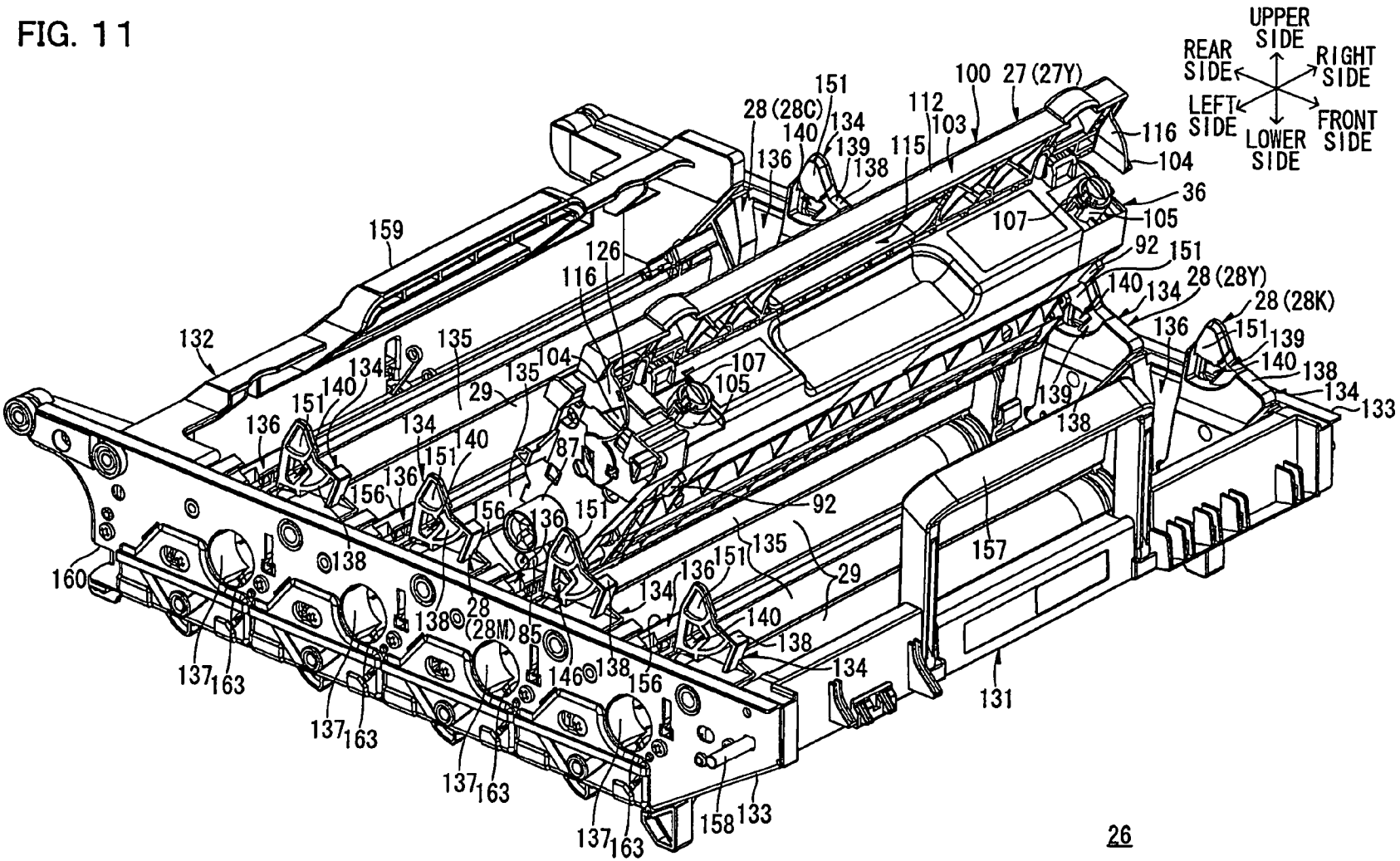
FIG. 11 is a perspective view of the drum unit (in an intermediate state of attaching/detaching the developer cartridge) as viewed from the upper front left side.
Figure 12:
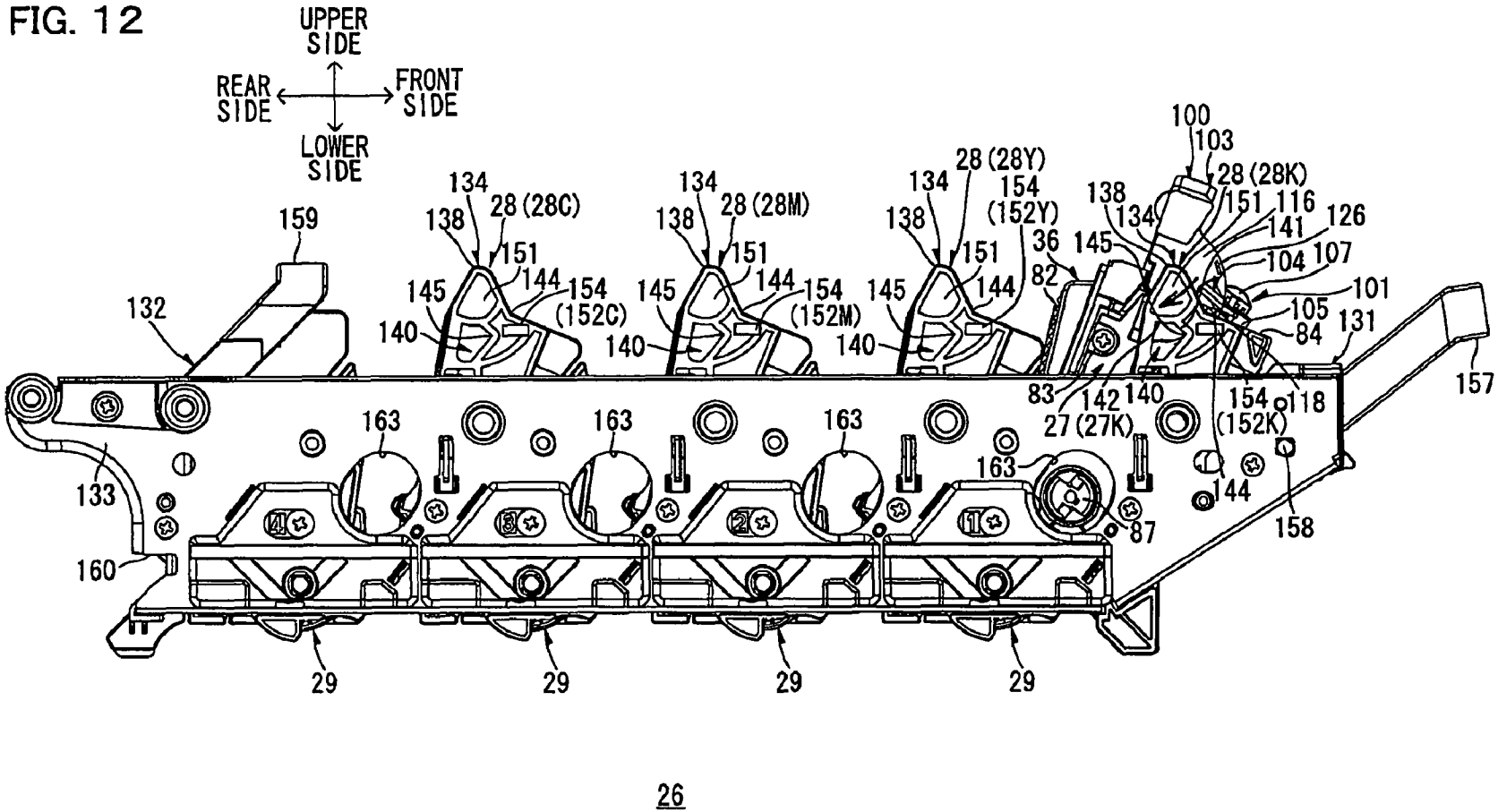
FIG. 12 is a left side elevational view of the drum unit to which the developer cartridge (with a grip located on a release position) is attached.
Figure 13:
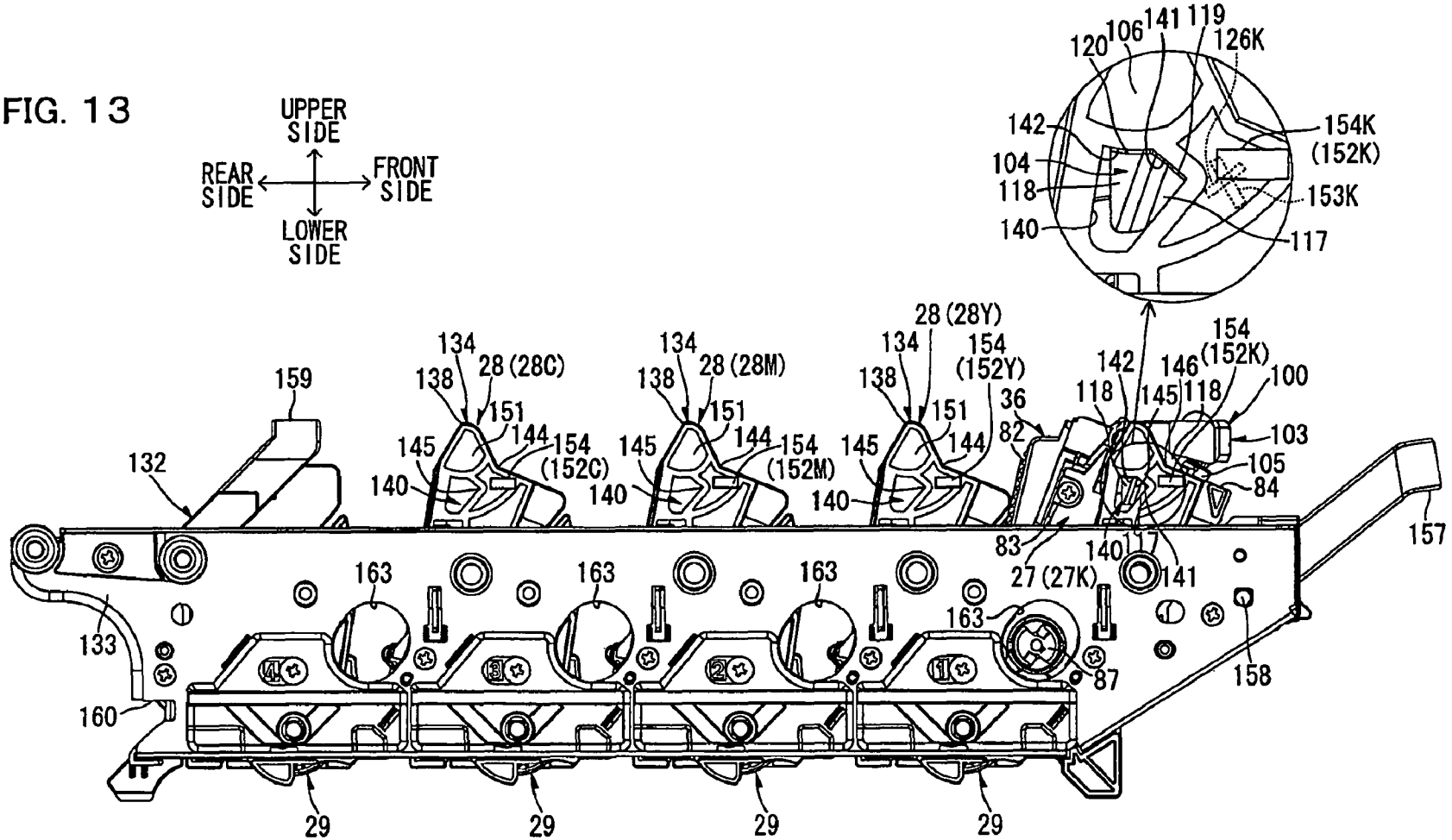
FIG. 13 is a left side elevational view of the drum unit to which the developer cartridge (with the grip located on a pressure contact position) is attached.

FIG. 8 is a plan view of the drum unit, FIG. 9 is a left side elevational view of the drum unit, FIG. 10 is a right side elevational view of a portion of the left side frame frontward of a cartridge guide groove, FIG. 11 is a perspective view of the drum unit (in an intermediate state of attaching/detaching the developer cartridge) as viewed from the upper front left side, FIG. 12 is a left side elevational view of the drum unit to which the developer cartridge (with the grip 103 located on the release position) is attached, and FIG. 13 is a left side elevational view of the drum unit to which the developer cartridge (with the grip 103 located on the pressure contact position) is attached.

The drum unit is now described in detail with reference to FIGS. 8 to 13.

This drum unit 26 includes the four drum subunits 28 corresponding to the respective colors parallelly arranged along the anteroposterior direction, a front beam 131 and a rear beam 132 arranged on both anteroposterior sides of the four drum subunits 28, and a pair of side plates 133 sandwiching the front beam 131, the four drum subunits 28 and the rear beam 132 therebetween from both sides in the width direction (right-and-left direction), as shown in FIG. 8.

The drum unit 26 is slidably attached to/detached from the drum receiving space 7 in the main body casing 2 together with the four drum subunits 28, the front beam 131, the rear beam 132 and the pair of side plates 133.

(1) Drum Subunit

Each drum subunit 28 includes the pair of side frames 134 opposed to each other at an interval in the width direction, and the center frame 135 extended between the side frames 134 along the width direction, as shown in FIGS. 8 and 9.

(1-1) Side Frame

Each side frame 134 is formed of a resin material in the form of a flat plate, as shown in FIG. 11. The side frame 134 is provided with the cartridge guide groove 136 for guiding the attachment/detachment of the developer cartridge 27 to/from the drum subunit 28.

The cartridge guide groove 136 is formed from the front upper end edge of the side frame 134 to the vicinity of the rear lower end of the side frame 134, generally along the up-and-down direction. The lower end portion (deepest portion) of the cartridge guide groove 136 is arranged correspondingly to the position of the developing roller shaft 51 on the position where the developing roller 39 is in contact with the photosensitive drum 29. The cartridge guide groove 136 slidably receives the collar member 85.

The left side frame 134 is provided with a coupling inner insertion hole 137 opposed to the coupling passive gear 87 in the width direction.

A portion (referred to as a front portion 138) of the side frame 134 frontward of the cartridge guide groove 136 is generally in the form of a downwardly narrowed triangle in side elevational view, as shown in FIG. 10.

In the front portion 138, an upwardly projecting protruding portion 151 is formed on the front end portion, and a fitting hole 140 is formed under the protruding portion 151. The fitting hole 140 is formed through the front portion 138 in the thickness direction (width direction), and has a shape similar to and slightly larger than the fitting projection 104 of the developer cartridge 27 in side elevational view (see FIG. 13).

An upper front end face 141 and an upper rear end face 142 having different angles are formed on an end face of the upper end portion of the fitting hole 140, to gradually separate from each other from the anteroposterior center toward both anteroposterior outer sides in side elevational view. The upper rear end face 142 extends in the horizontal direction (anteroposterior direction), and the upper front end face 141 is inclined downward.

On the front portion 138, a projection guide groove 139 is formed between a generally V-shaped portion 144 (hereinafter referred to as an upper V-shaped portion 144) provided on the front end portion of the protruding portion 151 and another generally V-shaped portion 145 (hereinafter referred to as a lower V-shaped portion 145) provided on the front end portion of the upper front end face 141 on the inner peripheral surface of the fitting hole 140.

The projection guide groove 139 is in the form of an arc along the locus of pivotal movement of the fitting projection 104 in side elevational view, as a troughlike passage concaved from the inner side surface of the front portion 138 outward in the width direction.

On the projection guide groove 139, an end face of the upper V-shaped portion 144 is formed as an upper inclined surface 146 inclined from the inner side surface of the projection guide groove 139 outward in the width direction, and an end face of the lower V-shaped portion 145 is formed as a lower inclined surface 147 inclined from the inner side surface of the projection guide groove 139 outward in the width direction.

(1-2) Center Frame

The center frame 135 is formed of a resin material in the form of a flat plate extending in the width direction, as shown in FIG. 8. On the upper end portion of the center frame 135, support rollers 156 guiding attachment/detachment of the developer cartridge 27 are provided on both end portions in the width direction.

(1-3) Second Terminal and Third Terminal

Each drum subunit 28 is provided with a second terminal 152 coming into contact with the first terminal 126 and a third terminal 171 (described later) to be electrically connected thereto, as shown in FIGS. 9 and 10.

The second terminal 152 is provided on the left front portion 138, and includes an inner terminal 153 and an outer terminal 154.

The inner terminal 153 is formed by a flat electrode, and provided on the inner side surface of the projection guide groove 139 of the front portion 138, as shown in FIG. 10. The inner terminal 153 is in the form of a long and narrow rectangle obliquely extending from the front lower side toward the rear upper side, orthogonally to the extensional direction of the first terminal 126.

On the inner side surface of the projection guide groove 139, the inner terminal 153 is arranged on a position varying with each color. More specifically, the black drum subunit 28K is provided with a black inner terminal 153K on a rear lower portion of the projection guide groove 139, to come into contact with only the black first terminal 126K. The yellow drum subunit 28Y is provided with a yellow inner terminal 153Y on a portion in front of and obliquely above the portion where the black inner terminal 153K is arranged, to come into contact with only the yellow first terminal 126Y. The magenta drum subunit 28M is provided with a magenta inner terminal 153M on a portion in front of and obliquely above the portion where the yellow inner terminal 153Y is arranged, to come into contact with only the magenta first terminal 126M. The cyan drum subunit 28C is provided with a cyan inner terminal 153C on a portion in front of and obliquely above the portion where the magenta inner terminal 153M is arranged, to come into contact with only the cyan first terminal 126C.

FIG. 10 shows the arrangement of the black inner terminal 153K with solid lines while showing the arrangements of the yellow, magenta and cyan inner terminals 153Y, 153M and 153C with phantom lines.

The outer terminal 154 is formed by a flat electrode, and provided on the outer side surface of the upper end portion of the front portion 138, as shown in FIG. 9. The outer terminal 154 is in the form of an anteroposteriorly extending rectangle on the front side of the fitting hole 140. More specifically, the black drum subunit 28K is provided with a black outer terminal 154K connected with the black inner terminal 153K. The yellow drum subunit 28Y is provided with a yellow outer terminal 154Y connected with the yellow inner terminal 153Y. The magenta drum subunit 28M is provided with a magenta outer terminal 154M connected with the magenta inner terminal 153M. The cyan drum subunit 28C is provided with a cyan outer terminal 154C connected with the cyan inner terminal 153C.

The inner terminal 153 and the outer terminal 154 are electrically connected with each other by wiring (not shown). The wiring (not shown) is connected from the inner terminal 153 to the outer terminal 154 penetrating the thickness direction (width direction) of the front portion 138.

The main body casing 2 is provided with the third terminal 171 corresponding to each outer terminal 154, as shown by phantom lines in FIG. 8.

The third terminal 171 is formed by a leaf spring electrode having flexibility in the width direction, and so arranged as to opposedly come into contact with each outer terminal 154 from the outer side in the width direction when the drum unit 26 is received in the drum receiving space 7. More specifically, a black third terminal 171K coming into contact with the black outer terminal 154K is opposed to the black drum subunit 28K. A yellow third terminal 171Y coming into contact with the yellow outer terminal 154Y is opposed to the yellow drum subunit 28Y. A magenta third terminal 171M coming into contact with the magenta outer terminal 154M is opposed to the magenta drum subunit 28M. A cyan third terminal 171C coming into contact with the cyan outer terminal 154C is opposed to the cyan drum subunit 28C.

Each third terminal 171 is electrically connected to a CPU 172 as an example of a control section provided in the main body casing 2.

(2) Front Beam

The front beam 131 is integrally molded from a resin material, arranged in front of the headmost drum subunit 28, and extended between the pair of side plates 133, as shown in FIGS. 8 and 11. The front beam 131 includes a support shaft 158 inserted along the width direction and a front-side grasp portion 157 generally U-shaped in front elevational view rotatably supported by the support shaft 158.

(3) Rear Beam

The rear beam 132 is integrally molded from a resin material, arranged at the back of the endmost drum subunit 28, and extended between the pair of side plates 133. The rear beam 132 generally has a flat-bottomed U-shape in plan view with an open rear portion, and integrally provided with a back-side grasp portion 159 generally U-shaped in rear elevational view at the center in the width direction.

(4) Side Plate

The pair of side plates 133 are each formed by a steel plate in the form of anteroposteriorly extending long and narrow rectangular plate in side elevational view, as shown in FIGS. 8 and 9. The pair of side plates 133 sandwiches the front beam 131, the four drum subunits 28 and the rear beam 132 in the width direction, to be fixed thereto.

Each side plate 133 is provided on the rear end portion thereof with a notched portion 160 notched from the rear end edge generally in a U-shaped manner in side elevational view. A positioning shaft (not shown) provided on the main body casing 2 is fitted into the notched portion 160 when the drum unit 26 is attached to the main body casing 2, thereby positioning the drum unit 26 with respect to the main body casing 2.

The left side plate 133 is provided with a coupling outer insertion hole 163 correspondingly to each coupling passive gear 87.

4. Attachment/Detachment of Developer Cartridge to/from Drum Unit (1) Attachment of Developer Cartridge to Drum Unit In order to attach each developer cartridge 27 to the drum unit 26, the user inserts his/her hand into the grasp hole 115 of the grip 103 of the developer cartridge 27 corresponding to each color to grasp the grip 103, for example. At this time, the grip 103 is swung upward on the front side, and arranged on the release position.

Then, the grasped developer cartridge 27 is attached to the drum subunit 28 corresponding to this developer cartridge 27 from above the drum unit 26, as shown in FIG. 11.

More specifically, each collar member 85 of the developer cartridge 27 is inserted into each cartridge guide groove 136 of the corresponding drum subunit 28, and the developer cartridge 27 is pushed down obliquely toward the rear side of the drum subunit 28 along the cartridge guide groove 136.

When the developing roller 39 comes into contact with the photosensitive drum 29, the operation of pushing down the developer cartridge 27 is prohibited. The developer cartridge 27 is inclined about the developing roller shaft 51 by the own weight thereof in such a direction that the upper end portion thereof recline against the front center frame 135, and the positioning convexes 92 of the developer frame 36 come into contact with and are supported by the support rollers 156 of the center frame 135. Thus, the developer cartridge 27 is positioned with respect to the drum subunit 28.

Then, the grip 103 is swung from the release position (see FIG. 6) in the pressure contact direction, whereby the fitting projection 104 is guided into the projection guide groove 139 while the rear-side inclined surface 118 slides along the upper inclined surface 146, as shown in FIG. 12. At this time, the fitting projection 104 moves inward in the width direction along the direction of inclination of the upper inclined surface 146, whereby the side plate 116 is deflected inward in the width direction following the movement of each fitting projection 104.

When the grip 103 is further swung in the pressure contact direction, the fitting projection 104 passes through the projection guide groove 139 while sliding on the projection guide groove 139, and the front inclined surface 117 is opposed to the lower inclined surface 147.

When the grip 103 is further swung in the pressure contact direction, the fitting projection 104 is guided into the fitting hole 140 while the front inclined surface 117 slides along the lower inclined surface 147. At this time, the fitting projection 104 moves outward in the width direction along the direction of inclination of the lower inclined surface 147, whereby the side plate 116 is restored outward in the width direction following the movement of the fitting projection 104.

The fitting projection 104 guided into the fitting hole 140 is fitted into the fitting hole 140 and engaged as shown in FIG. 13, and the grip 103 is arranged on the pressure contact position (see FIG. 7). Thus, the developer cartridge 27 is attached to the drum unit 26.

When the grip 103 is swung from the release position to the pressure contact position in the aforementioned manner, the recess 121 of the grip 103 comes into contact with the abutting member 107, to press the abutting member 107. Then, the spring 102 presses the developer frame 36 toward the downstream side of the direction (hereinafter referred to as an attachment direction) for attaching the developer cartridge 27 to the drum subunit 28. Then, the developing roller 39 is brought into pressure contact with the photosensitive drum 29.

When the fitting projection 104 is engaged in the fitting hole 140, the grip 103 is kept in pressure contact with the abutting member 107, whereby the developing roller 39 is kept in pressure contact with the photosensitive drum 29 due to the pressing force of the spring 102.

Even if the user tries to pull the developer cartridge 27 out of the drum subunit 28 toward the downstream side in a direction (hereinafter referred to as a detachment direction) for detaching the developer cartridge 27 from the drum subunit 28, i.e., obliquely toward the front upper side, the upper front end face 141 and the upper rear end face 142 of the fitting hole 140 and the front end face 119 and the rear end face 120 of the fitting projection 104 come into contact with each other respectively, whereby the developer cartridge 27 is prevented from being detached from the drum subunit 28, due to the interference between these end faces 141, 142 and 119, 120.

When the grip 103 is arranged on the pressure contact position, the first terminal 126 and the inner terminal 153 come into contact with each other in the width direction orthogonal to the pressure contact direction following the outward restoration of the side plates 116 in the width direction, as shown in FIG. 13. More specifically, the inner terminal 153 comes into contact with the first terminal 126 from the outer side in the width direction. Further specifically, the inner terminal 153 generally cruciformly comes into contact with the first terminal 126 formed along the swinging direction, in the direction orthogonal thereto. Thus, the first and second terminals 126 and 152 are electrically connected with each other.

(2) Detachment of Developer Cartridge from Drum Unit

In order to detach the developer cartridge 27 from the drum unit 26, on the other hand, the grip 103 is grasped and swung in the front upper direction (the pressing release direction). Then, the fitting projection 104 is released from the fitting hole 140, and guided into the projection guide groove 139 while the front inclined surface 117 slides along the lower inclined surface 147. At this time, the fitting projection 104 moves inward in the width direction along the direction of inclination of the lower inclined surface 147, whereby the side plate 116 is deflected inward in the width direction following the movement of the fitting projection 104.

When the grip 103 is further swung in the pressing release direction, the fitting projection 104 passes through the projection guide groove 139 while sliding along the projection guide groove 139, and the rear inclined surface 118 is opposed to the upper inclined surface 146.

Further, when the grip 103 is swung in the pressing release direction, the fitting projection 104 is guided to a portion above the upper V-shaped portion 144 while the rear inclined surface 118 is in sliding contact with the upper inclined surface 146. At this time, the fitting projection 104 moves outward in the width direction along the direction of inclination of the upper inclined surface 146, whereby the side plate 116 is restored outward in the width direction following the movement of the fitting projection 104.

When the grip 103 is swung in the pressing release direction, as described above, the recess 121 of the grip 103 separates from the abutting member 107 due to the swinging of the grip 103 from the pressure contact position to the release position, to release the spring 102 from the state pressing the developing roller 39. Thus, the developing roller 39 is released from the pressure contact with the photosensitive drum 29.

Thereafter the developer cartridge 27 is pulled out toward the downstream side in the detachment direction while the grip 103 is grasped, whereby the collar member 85 is obliquely lifted up toward the front side along the cartridge guide groove 136, and the developer cartridge 27 is detached from the drum unit 26.

5. Attachment/Detachment of Drum Unit to/from Main Body Casing (1) Attachment of Drum Unit to Main Body Casing After all the developer cartridges 27 are attached to the drum unit 26, the drum unit 26 is attached to the main body casing 2.

In order to attach the drum unit 26 to the main body casing 2, the front cover 8 of the main body casing 2 is inclined frontward, to open the drum receiving space 7.

Then, the front-side grasp portion 157 and the back-side grasp portion 159 are grasped, and the drum unit 26 is lifted up and inserted into the drum receiving space 7. Thereafter the back-side grasp portion 159 is released, and the drum unit 26 is pushed into the drum receiving space 7 rearward from the front side. Then, the drum unit 26 is guided by guide rails (not shown) in the drum receiving space 7, and inserted along the anteroposterior direction.

The notch portions 160 of the side plates 133 are fitted with the positioning shafts (not shown) provided on the main body casing 2, so that the drum unit 26 is positioned with respect to the main body casing 2. Thus, the drum unit 26 is attached in the main body casing 2, and received in the drum receiving space 7.

Thereafter the front cover 8 is uprighted along the front surface of the main body casing 2, to close the drum receiving space 7.

When the drum unit 26 is received in the drum receiving space 7, each outer terminal 154 and each third terminal 171 come into contact with each other in the width direction, and each second terminal 152 and each third terminal 171 are electrically connected with each other, as shown in FIG. 8.

Thus, the CPU 172 provided in the main body casing 2 is electrically connected to the IC memory 125 provided on each developer cartridge 27 through the third terminal 171, the second terminal 152 and the first terminal 126. Then, the CPU 172 reads the information stored in the IC memory 125.

(2) Detachment of Drum Unit from Main Body Casing

In order to detach the drum unit 26 from the main body casing 2, the front cover 8 of the main body casing 2 is inclined frontward, to open the drum receiving space 7.

Then, the front-side grasp portion 157 is grasped, and the drum unit 26 pulled out frontward from the rear side. Thus, the drum unit 26 is guided by the guide rails (not shown) in the drum receiving space 7 and pulled out along the anteroposterior direction. When the drum unit 26 is exposed from the drum receiving space 7, the back-side grasp portion 159 is also grasped, to lift up the drum unit 26. Thus, the drum unit 26 is detached from the main body casing 2.

6. Functions/Effects of Embodiment (1) In this color laser printer 1, as hereinabove described, the developing roller 39 is brought into pressure contact with the photosensitive drum 29 when the developer cartridge 27 is attached to the drum subunit 28. When the developing roller 39 is brought into pressure contact with the photosensitive drum 29, each first terminal 126 and each second terminal 152 are electrically connected with each other. In other words, each first terminal 126 and each second terminal 152 are electrically connected with each other due to the developing roller 39 coming into pressure contact with the photosensitive drum 29.

Therefore, the pressure contact between the developing roller 39 and the photosensitive drum 29 is not inhibited due to the electric connection between each first terminal 126 and each second terminal 152, but excellent development from the developing roller 39 to the photosensitive drum 29 can be attained.

In this color laser printer 1, each first terminal 126 and each second terminal 152 can be reliably electrically connected with each other through a simple structure. When the drum unit 26 is attached to the main body casing 2, further, each second terminal 152 and each third terminal 171 can be reliably electrically connected with each other, whereby the CPU 172 can reliably read the information from the IC memory 125.

(2) In the developer cartridge 27, the first terminal 126 is provided on the grip 103. When the grip 103 is swung from the release position to the pressure contact position, therefore, the first terminal 126 can be reliably electrically connected with the second terminal 152. When the grip 103 is swung from the pressure contact position to the release position, on the other hand, the first terminal 126 can be reliably electrically disconnected from the second terminal 152. Consequently, the first terminal 126 can be reliably electrically connected with and disconnected from the second terminal 152 by the simple operation of swinging the grip 103 between the release position and the pressure contact position.

(3) More specifically, the first terminal 126 and the second terminal 152 can be electrically connected with each other by grasping the grip 103 and approaching the front side of the grasp plate 112 to the upper wall 84, and the first terminal 126 can be electrically disconnected from the second terminal 152 by separating the front side of the grasp plate 112 from the upper wall 84. Consequently, the first terminal 126 can be reliably electrically connected with and disconnected from the second terminal 152 by simply swinging the grip 103.

When the first terminal 126 is provided on the grip 103, no additional member may be provided for separately supporting the first terminal 126, and the number of the components can be reduced.

(4) When the grip 103 is arranged on the pressure contact position, the first terminal 126 and the inner terminal 153 come into contact with each other in the width direction orthogonal to the pressure contact direction, following the outward restoration of the side plate 116 in the width direction. Therefore, the contact between the first terminal 126 and the inner terminal 153 can be prevented from influencing the pressure contact between the developing roller 39 and the photosensitive drum 29. Consequently, excellent development from the developing roller 39 to the photosensitive drum 29 can be attained.

(5) More specifically, the inner terminal 153 comes into contact with the first terminal 126 from the outer side in the width direction. Therefore, the second terminal 152 can be reliably brought into contact with the first terminal 126.

(6) When the grip 103 is arranged on the pressure contact position, the inner terminal 153 generally cruciformly comes into contact with the first terminal 126 formed along the swinging direction, in the direction orthogonal thereto. If the first terminal 126 and the inner terminal 153 are so formed as to come into contact with each other in the same direction, for example, the contact therebetween may not be attained if the terminals 126 and 153 even slightly shift from each other. When the first terminal 126 and the inner terminal 153 are so formed as to generally cruciformly come into contact with each other as described above, however, the contact therebetween can be ensured even if the terminals 126 and 153 slightly shift from each other.

(7) In this color laser printer 1, each first terminal 126 and each inner terminal 153 come into contact with each other on the position varying with each color. If a developer cartridge 27 corresponding to a certain color is falsely attached to a drum subunit 28 corresponding to a different color, therefore, the first terminal 126 of this developer cartridge 27 is arranged on a position different from that for the inner terminal 153, and prevented from coming into contact with the inner terminal 153. Consequently, the first terminal 126 can be easily and reliably prevented from being electrically connected with the inner terminal 153 when the developer cartridge 27 is falsely attached to the drum subunit 28 corresponding to a different color.

(8) In the developer cartridge 27, the first terminal 126 is provided not on the grasp plate 112 but on the side plate 116. When inserting his/her hand into the grasp hole 115 of the grasp plate 115 for grasping the grip 103, therefore, the user can be prevented from touching the first terminal 126.

(9) The first terminal 126 is provided along the swinging direction of the grip 103. When the grip 103 is swung, therefore, the first terminal 126 can come into contact with the inner terminal 153 on a constant position in a wide range. Consequently, the first terminal 126 can be reliably electrically connected with the inner terminal 153.

7. Modifications

Second Embodiment (1) Modification 1

Figure 14:
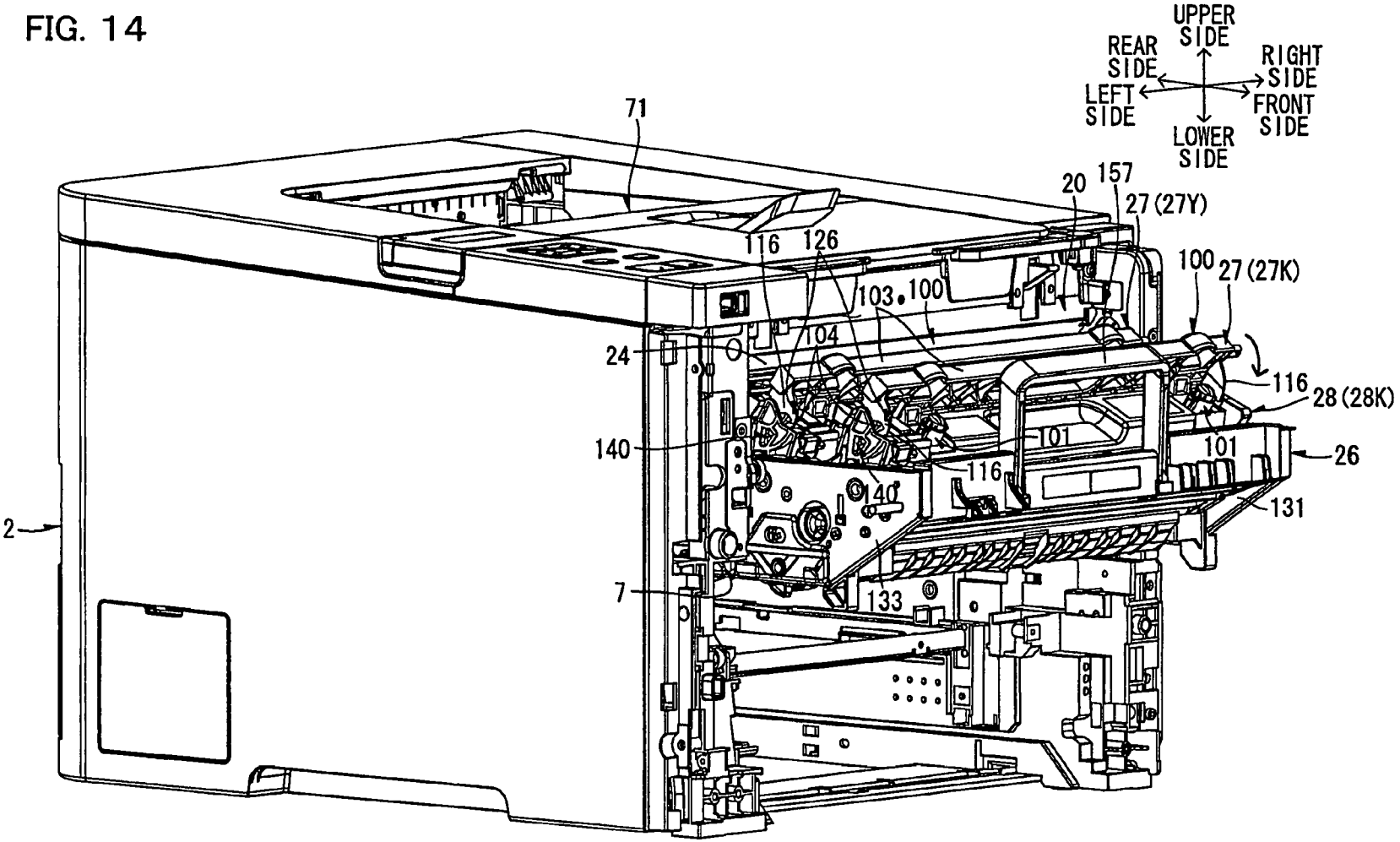
FIG. 14 is a perspective view showing an intermediate state of attaching the drum unit to a main body casing, as viewed from the front left side.

While the grip 103 is grasped and swung in the pressure contact direction from the release position to the pressure contact position when the developer cartridge 27 is attached to the drum subunit 28 in the above description, the grip 103 may alternatively be brought into contact with the front wall surface of the scanner casing 24 in the drum receiving space 7 to be swung in the pressure contact direction from the release position to the pressure contact position, when the drum unit 26 is introduced into the drum receiving space 7 of the main body casing 2, as shown in FIG. 14, for example, in order to attach the developer cartridge 27 to the drum subunit 28.

More specifically, after each of the four developer cartridges 27 is attached to the corresponding drum subunit 28, the front-side grasp portion 157 and the back-side grasp portion 159 are grasped, and the drum unit 26 is pushed into the drum receiving space 7 rearward from the front side. Then, the grip 103 of the developer cartridge 27 successively comes into contact with the front wall surface of the scanner casing 24 in the drum receiving space 7 following the insertion of the drum unit 26 into the drum receiving space 7, to be pressed by the front wall surface and swung in the pressure contact direction from the release position to the pressure contact position. Then, the fitting projection 104 is engaged into the fitting hole 140.

When swung from the release position to the pressure contact position in the aforementioned manner, the grip 103 is invariably swung in the pressure contact direction from the release position to the pressure contact position upon insertion of the drum unit 26 into the drum receiving space 7 of the main body casing 2 even if the grip 103 is not manually swung in the pressure contact direction accidentally when the developer cartridge 27 is attached to the drum subunit 28, whereby the first terminal 126 can be reliably electrically connected with the second terminal 152.

Third Embodiment (2) Modification 2

While the first terminal 126 is provided on the left side plate 116 and the inner terminal 153 is provided on the inner side surface of the projection guide groove 139 so that the terminals 126 and 153 are regularly in contact with each other when the grip 103 is arranged on the pressure contact position in the above description, the first terminal 126 may alternatively be provided on the rear-side inclined surface 118 of the fitting projection 104 as shown by dotted lines in FIG. 4, and the inner terminal 153 may alternatively be provided on the upper inclined surface 146 of the front portion 138 as shown by dotted lines in FIG. 10, for example, so that the terminals 126 and 153 may come into contact with each other only when the grip 103 is swung, i.e., only when the developing roller 39 is brought into pressure contact with the photosensitive drum 29.

In this case, the first terminal 126 and the inner terminal 153 are not regularly in contact with each other, but come into contact with each other only when the rear-side inclined surface 118 slides along the upper inclined surface 146 while the grip 103 is swung between the release position and the pressure contact position. When the first terminal 126 and the inner terminal 153 come into contact with each other, the CPU 172 is electrically connected to the IC memory 125 through the third terminal 171, the second terminal 152 and the first terminal 126, and reads the information stored in the IC memory 125. When the grip 103 is arranged on the pressure contact position, the first terminal 126 and the inner terminal 153 are separated from each other.

Fourth Embodiment (3) Modification 3

Figure 15:
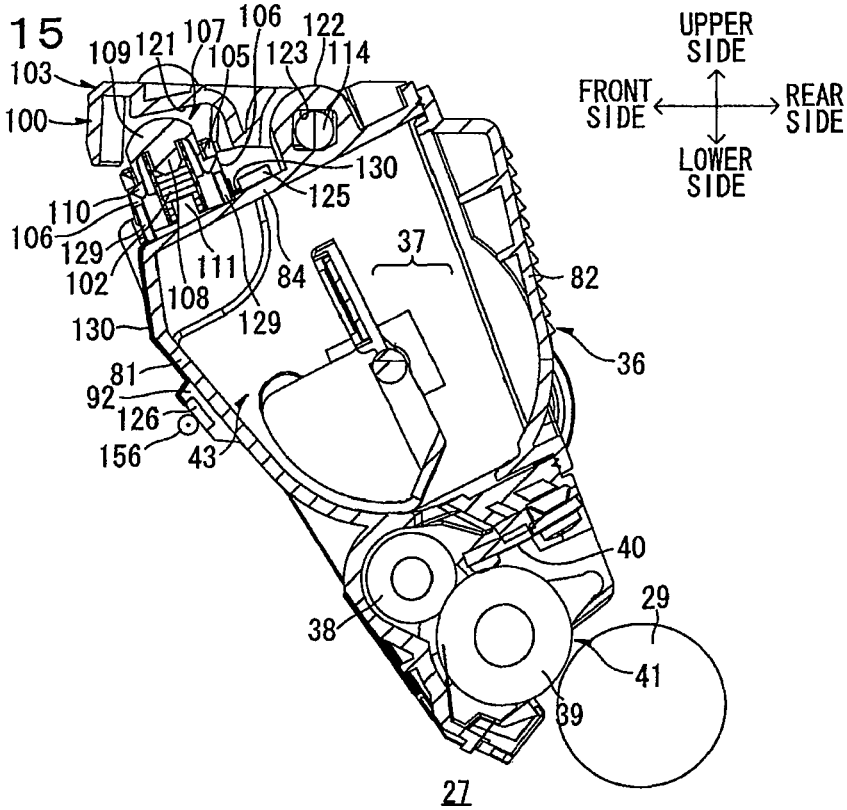
FIG. 15 is a sectional view showing another illustrative aspect of the developer cartridge (unpressed state).
Figure 16:
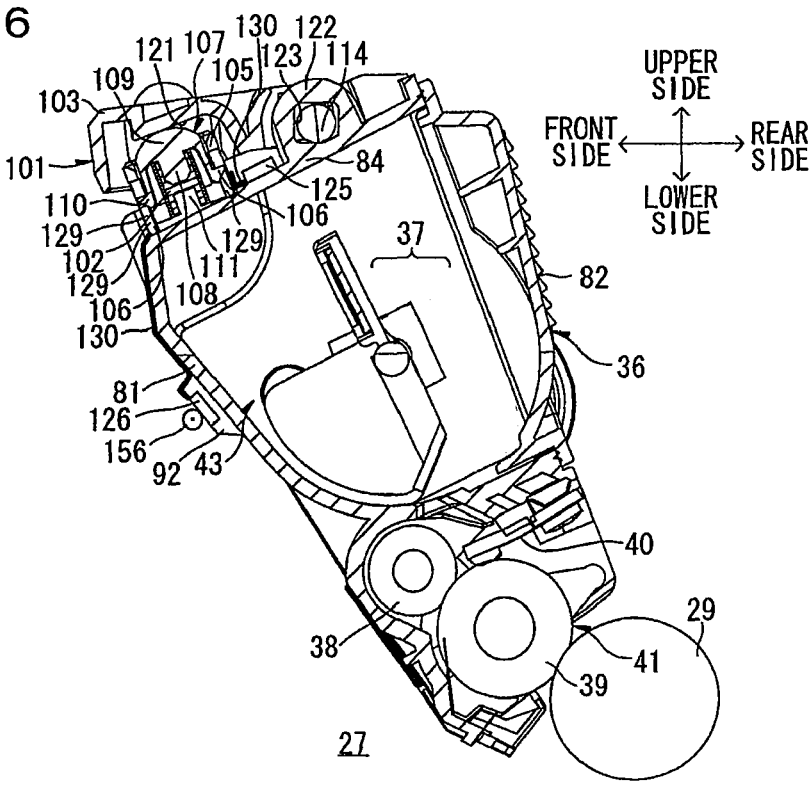
FIG. 16 is a sectional view showing still another illustrative aspect of the developer cartridge (pressed state).

Further, the first terminal 126 and the second terminal 152 may be regularly in contact with each other when the developer cartridge 27 is attached to the drum subunit 28, while the IC memory 125 and the first terminal 126 may be electrically disconnected from each other when the grip 103 is arranged on the release position, and the IC memory 125 and the first terminal 126 may be electrically connected with each other when the grip 103 is arranged on the pressure contact position, as shown in FIGS. 15 and 16, for example.

FIG. 15 a sectional view showing another illustrative aspect of the developer cartridge (unpressed state), and FIG. 16 is a sectional view showing still another illustrative aspect of the developer cartridge (pressed state). Referring to FIGS. 15 and 16, members similar to the aforementioned members are denoted by the same reference numerals, to omit descriptions thereof.

In the illustrative aspect shown in FIGS. 15 and 16, the IC memory 125 is provided on the upper wall 84. The first terminal 126 is embedded in the positioning convex 92 so that the surface thereof is exposed.

The support roller 156 of the drum subunit 28 is made of conductive resin, and electrically connected to the CPU 172. This support roller 156 also functions as the second terminal 152.

Relay terminals 129 are provided on the inner peripheral surfaces of the engaging grooves 106 of the spring receiving cylindrical portions 105. The relay terminals 129 are provided on generally half portions on the lower sides of the inner peripheral surfaces of the two engaging grooves 106 respectively. The abutting member 107 is an example of an elastic member, and made of conductive resin.

The IC memory 125 and one of the relay terminals 129 are electrically connected with each other through a wiring 130. The other relay terminal 129 and the first terminal 126 are electrically connected with each other through the wiring 130.

In the illustrative aspect shown in FIGS. 15 and 16, the positioning projection 92 comes into contact with the support roller 156 and the developer cartridge 27 is positioned with respect to the drum subunit 28 as hereinabove described, whereby the first terminal 126 and the second terminal 152 come into contact with and are electrically connected with each other due to this positioning.

At this time, the grip 103 is arranged on the release position, and the hook portions 110 of the abutting member 107 are engaged with the upper end portions of the engaging grooves 106 and separated from the relay terminals 129, as shown in FIG. 15. Therefore, the IC memory 125 and the first terminal 126 are electrically disconnected from each other on the abutting member 107 provided on an intermediate position of the wiring 130.

When the grip 103 is then swung from the release position to the pressure contact position, the abutting member 107 is pressed by the grip 103 to move downward against the pressing force of the spring 102, and the hook portions 110 come into contact with the relay terminals 129, as shown in FIG. 16. Then, the wiring 130 is allowed to conduct between the IC memory 125 and the first terminal 126, and the IC memory 125 and the first terminal 126 are electrically connected with each other through the wiring 130, the one relay terminal 129, the abutting member 107, the other relay terminal 129 and the wiring 130.

When the grip 103 is swung from the pressure contact position to the release position, on the other hand, the abutting member 107 is released from the grip 103 to move upward due to the pressing force of the spring 102, and the hook portions 110 are separated from the relay terminals 129, as shown in FIG. 15. Then, the conduction of the wiring 130 is interrupted between the IC memory 125 and the first terminal 126, and the abutting member 107 electrically disconnects the IC memory 125 and the first terminal 126 from each other.

In other words, the abutting member 107 is pressed and the wiring 130 is allowed to conduct when the grip 103 is swung from the release position to the pressure contact position in the illustrative aspect shown in FIGS. 15 and 16. Thus, the IC memory 125 and the first terminal 126 can be electrically connected with each other. When the grip 103 is swung from the pressure contact position to the release position, on the other hand, the abutting member 107 is released from the pressing, to interrupt the conduction of the wiring 130. Thus, the IC memory 125 and the first terminal 126 can be electrically disconnected from each other. Consequently, the IC memory 125 and the first terminal 126 can be reliably electrically connected with and disconnected from each other.

Fifth Embodiment (4) Modification 4

While the tandem type color laser printer is illustrated as the image forming apparatus in the above description, the image forming apparatus to which the photosensitive unit and the developer cartridge according to the present invention are attached is not limited to the above, but includes an intermediate transfer type color laser printer temporarily transferring developing agent images of respective colors from photosensitive bodies to an intermediate transfer body and thereafter collectively transferring the same to a recording medium, and a monochromatic laser printer, for example.

While the aforementioned color laser printer 1 includes the scanning section 20 and exposes an electrostatic latent image formed on the photosensitive drum 29 with the laser, the exposing apparatus is not limited to the aforementioned scanning section 20. Alternatively, an apparatus formed by arranging a large number of light-emitting devices such as LEDs (light-emitting diodes), EL (electroluminescence) elements or fluorescent materials and selectively emitting light from the light-emitting devices according to image data, or an apparatus formed by arranging a large number of optical shutters formed by liquid crystal elements or PLZTs and selectively controlling opening/closing times for these optical shutters according to image data to control light received from a light source can be properly employed, for example.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. An image forming apparatus comprising:

a developer cartridge comprising:

a first casing configured to accommodate a developing agent;

a developing agent carrier supported by the first casing and configured to carry the developing agent;

a memory element configured to stored predetermined information; and a first terminal electrically connected with the memory element;

a photosensitive unit comprising:

a second casing to which the developer cartridge is detachably attached;

a photosensitive member, with which the developing agent carrier is brought into pressure contact when the developer cartridge is attached to the second casing, supported by the second casing; and a second terminal configured to be electrically connected with the first terminal when the developing agent carrier is brought into pressure contact with the photosensitive member; and a main body unit comprising:

a third casing configured to receive the photosensitive unit;

a control section provided in the third casing; and a third terminal electrically connected with the control section, and configured to be electrically connected with the second terminal when the third casing receives the photosensitive unit, wherein the first casing comprises a pressing member configured to move between a pressure contact position in which the developing agent carrier is in pressure contact with the photosensitive member and a release position in which the developing agent carrier is released from pressure contact with the photosensitive member, wherein the first terminal is provided in the pressing member.

2. The image forming apparatus according to claim 1, wherein the pressing member is a grip having one end pivotably supported by the first casing and the other end configured to be swung to approach or separate from the first casing.

3. The image forming apparatus according to claim 1, wherein the first terminal and the second terminal are configured to contact each other in a direction intersecting with a pressure contact direction in which the developing agent carrier is brought into pressure contact with the photosensitive member.

4. The image forming apparatus according to claim 3, wherein the second terminal externally comes into contact with the first terminal in a direction parallel to an axial direction of the developing agent carrier.

5. The image forming apparatus according to claim 3, wherein a plurality of the developer cartridges and a plurality of the second terminals are provided correspondingly to a plurality of colors used by the image forming apparatus to form images, and the first terminal of each of the respective developer cartridges and each of the second terminals come into contact with each other at a different position depending on the respective color.

6. The image forming apparatus according to claim 1, wherein the first terminal and the second terminal come into contact with each other to intersect with each other when the developing agent carrier is brought into pressure contact with the photosensitive member.

7. The image forming apparatus according to claim 1, wherein the first casing comprises:

wiring connecting the memory element and the first terminal; and an elastic member provided on an intermediate position of the wiring, configured to be pressed by the pressing member to allow conduction of the wiring when the pressing member moves from the release position to the pressure contact position, and released from the pressing by the pressing member to interrupt the conduction of the wiring when the pressing member moves from the pressure contact position to the release position.

8. A developer cartridge comprising:

a first casing configured to accommodate a developing agent;

a developing agent carrier supported by the first casing and configured to carry the developing agent;

a grip having one end pivotably supported by the first casing and the other end configured to be swung to approach or separate from the first casing;

a memory element configured to store predetermined information; and a first terminal electrically connected with the memory element and provided on the grip.

9. The developer cartridge according to claim 8, wherein the grip comprises:

a grasp portion extending in a direction parallel to a longitudinal direction of the developing agent carrier; and a side portion provided on a longitudinal end portion of the grasp portion and extending in a direction orthogonal to the longitudinal direction of the grasp portion, and the first terminal is provided on the side portion.

10. The developer cartridge according to claim 9, wherein the first terminal is provided to extend along a swinging direction of the grip.

11. A developer cartridge comprising:

a first casing configured to accommodate a developing agent;

a developing agent carrier supported by the first casing and configured to carry the developing agent;

a grip having one end pivotably supported by the first casing and the other end configured to be swung to approach or separate from the first casing;

a memory element configured to store predetermined information;

a first terminal electrically connected with the memory element and provided on the grip;

wiring connecting the memory element and the first terminal with each other; and an elastic member provided on an intermediate position of the wiring, pressed by the grip to allow conduction of the wiring when the other end of the grip is swung in a direction for approaching to the first casing, and released from pressing by the grip to interrupt the conduction of the wiring when the other end of the grip is swung in a direction for separating from the first casing.

12. A photosensitive unit comprising:

a first casing configured to receive a developer cartridge comprising:

a second casing accommodating a developing agent;

a developing agent carrier supported by the second casing and configured to carry the developing agent;

a grip having one end pivotably supported by the second casing and the other end configured to be swung to approach or separate from the second casing;

a memory element configured to store predetermined information; and a first terminal electrically connected with the memory element and provided on the grip;

a photosensitive member, with which the developing agent carrier is brought into pressure contact when the developer cartridge is attached to the first casing, supported by the first casing; and a second terminal configured to be electrically connected with the first terminal when the developing agent carrier is brought into pressure contact with the photosensitive member.

13. The photosensitive unit according to claim 12, wherein the second terminal is configured to contact the first terminal in a direction intersecting with a pressure contact direction in which the developing agent carrier is brought into pressure contact with the photosensitive member.

14. The photosensitive unit according to claim 13, wherein the second terminal externally comes into contact with the first terminal in a direction parallel to an axial direction of the developing agent carrier.

15. The photosensitive unit according to claim 13, wherein a plurality of the developer cartridges and a plurality of the second terminals are provided correspondingly to a plurality of colors used by the image forming apparatus to form images, and the first terminal of each of the respective developer cartridges and each of the second terminals come into contact with each other at a different position dependent on the respective color.

16. The photosensitive unit according to claim 12, wherein the second terminal comes into contact with the first terminal to intersect therewith when the developing agent carrier is brought into pressure contact with the photosensitive member.

* * * * *